US009570811B2

(12) United States Patent
Ohshima et al.

(10) Patent No.: US 9,570,811 B2
(45) Date of Patent: Feb. 14, 2017

(54) DEVICE TO REFLECT AND TRANSMIT ELECTROMAGNETIC WAVE AND ANTENNA DEVICE

(71) Applicant: FUJITSU LIMITED, Kawasaki-shi, Kanagawa (JP)

(72) Inventors: Takenori Ohshima, Kawasaki (JP); Yoji Ohashi, Fucyu (JP); Yukio Takeda, Machida (JP); Kazumi Kasai, Shibuya (JP)

(73) Assignee: FUJITSU LIMITED, Kawasaki (JP)

( * ) Notice: Subject to any disclaimer, the term of this patent is extended or adjusted under 35 U.S.C. 154(b) by 309 days.

(21) Appl. No.: 14/340,337

(22) Filed: Jul. 24, 2014

(65) Prior Publication Data

US 2015/0029070 A1 Jan. 29, 2015

(30) Foreign Application Priority Data

Jul. 29, 2013 (JP) ..... 2013-156854

(51) Int. Cl.

| | |
|---|---|
| ***H01Q 21/00*** | (2006.01) |
| ***H01Q 19/10*** | (2006.01) |
| ***H01Q 15/00*** | (2006.01) |
| ***H01Q 15/22*** | (2006.01) |
| ***H01Q 15/24*** | (2006.01) |

(52) U.S. Cl.

CPC ..... *H01Q 15/0006* (2013.01); *H01Q 15/22* (2013.01); *H01Q 15/242* (2013.01); *H01Q 19/10* (2013.01)

(58) Field of Classification Search

CPC ..... H01Q 15/22; H01Q 15/14; H01Q 19/10; H01Q 19/185

See application file for complete search history.

(56) References Cited

U.S. PATENT DOCUMENTS

| | | | | |
|---|---|---|---|---|
| 6,225,957 | B1 * | 5/2001 | Yamaguchi | H01Q 15/23 343/755 |
| 2004/0239576 | A1 * | 12/2004 | Matsumoto | H01Q 15/0013 343/840 |
| 2005/0012842 | A1 * | 1/2005 | Miyagawa | H04N 1/00129 348/333.01 |
| 2005/0185195 | A1 * | 8/2005 | Seko | G01S 5/16 356/614 |

(Continued)

FOREIGN PATENT DOCUMENTS

JP 11-055028 A 2/1999

OTHER PUBLICATIONS

Edfors, et al., "Is Orbital Angular Momentum (OAM) Based Radio Communication an Unexploited Area?" IEEE Transactions on Antennas and Propagation, pp. 1126-1131, vol. 60, No. 2, Feb. 2012.

(Continued)

*Primary Examiner* — Trinh Dinh

(74) *Attorney, Agent, or Firm* — Arent Fox LLP

(57) ABSTRACT

A device includes a dielectric, wherein a front and a back of the dielectric for reflecting and transmitting an electromagnetic wave are defined by a first surface and a second surface, the first or second surface forming a half mirror, the first surface has a height that changes in spiral as leaving from the second surface, and the second surface has a height that changes in spiral as leaving from the first surface.

10 Claims, 25 Drawing Sheets

(56) References Cited

U.S. PATENT DOCUMENTS

| | | | | |
|---|---|---|---|---|
| 2006/0132379 | A1* | 6/2006 | Peterson | H01Q 3/46 343/910 |
| 2011/0198501 | A1* | 8/2011 | Ouchi | A61B 5/0059 250/343 |
| 2011/0210260 | A1* | 9/2011 | Sekiguchi | G01J 3/42 250/393 |
| 2014/0337402 | A1* | 11/2014 | Tago | G06F 17/5018 708/424 |

OTHER PUBLICATIONS

Jian Wang, et al., "Terabit free-space data transmission employing orbital angular momentum multiplexing," Nature Photonics, pp. 488-496, vol. 6, Macmillan Publishers Limited, Jul. 2012.

Tamburini, et al., "Encoding many channels on the same frequency through radio vorticity: first experimental test," New Journal of Physics 14 (2012) 033001, pp. 1-17, Mar. 1, 2012.

* cited by examiner

DEVICE TO REFLECT AND TRANSMIT ELECTROMAGNETIC WAVE AND ANTENNA DEVICE

CROSS-REFERENCE TO RELATED APPLICATION

This application is based upon and claims the benefit of priority of the prior Japanese Patent Application No. 2013-156854, filed on Jul. 29, 2013, the entire contents of which are incorporated herein by reference.

FIELD

The embodiments discussed herein are related to a device to reflect and transmit an electromagnetic wave and to an antenna device.

BACKGROUND

In recent years, there have been researches on a technique to improve transmission efficiency of wireless communication and the like by carrying out multiplex communication utilizing orbital angular momentum (OAM) of an electromagnetic wave (for example, refer to Fabrizio Tamburini, et al., "Encoding many channels on the same frequency through radio vorticity: first experiment test", New Journal of Physics 14 (2012) 033001 (17 pp), 1 Mar. 2012, and Edfors, Ove et al., "Is orbital angular momentum (OAM) based radio communication an unexploited area?", IEEE Transactions on Antennas and Propagation, 2012, vol. 60:2, pp. 1126-1131). Since electromagnetic waves having different modes of orbital angular momentum (OAM) is possible to exist in the same space at the same time, it is considered that a plurality of electromagnetic waves having different modes of orbital angular momentum (OAM) are superimposed to be sent from a sending machine to a receiving machine. The receiving device carries out an opposite process corresponding to that on the sending side, thereby being capable of separating the received electromagnetic wave into electromagnetic waves corresponding to the individual orbital angular momentum (OAM).

SUMMARY

According to an aspect of the invention, a device includes a dielectric, wherein a front and a back of the dielectric for reflecting and transmitting an electromagnetic wave are defined by a first surface and a second surface, the first or second surface forming a half mirror, the first surface has a height that changes in spiral as leaving from the second surface, and the second surface has a height that changes in spiral as leaving from the first surface.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1:
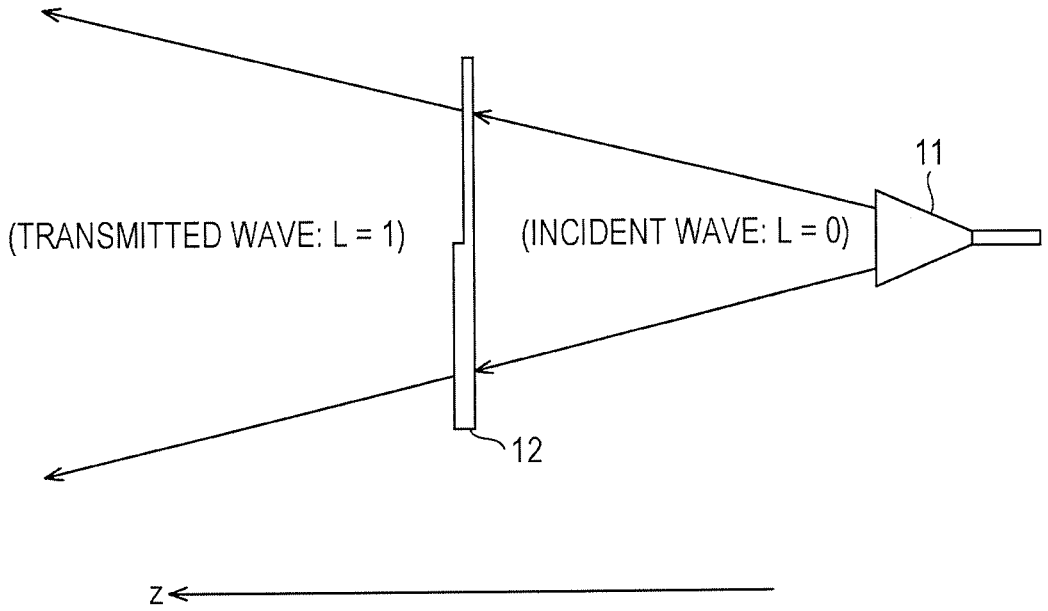
FIG. 1 illustrates a situation that an electromagnetic wave emitted from a horn antenna is incident on an OAM filter and transmitted.

Since the device in the past that sends and receives an electromagnetic wave utilizing orbital angular momentum (OAM) includes a large number of parts, there is a concern of a problem that the device configuration and the manufacturing procedure become complex and the costs increase.

It is desired to simplify configuration of a device that carries out multiplexing and separation of an electromagnetic wave utilizing orbital angular momentum (OAM) of the electromagnetic wave.

Descriptions are given to embodiments from the following perspective with reference to the attached drawings. In the drawings, the same reference character is given to similar elements. It is to be noted that the drawings do not express actual dimensions in all cases and some elements are emphasized more than other elements.

Table of Contents

1. Orbital angular momentum (OAM)
2. Antenna device
2.1 antenna device
2.2 Demultiplexer
2.3 Method of determining level difference
3. Communication system
4. Triple multiplex (part 1)
5. Triple multiplex (part 2)
6. Modifications The above classification of headings 1 to 6 does not have to be made for embodiments and is made merely for convenience of description. Accordingly, a matter described in a certain heading may be combined with a matter described in another heading as long as there is no conflict.

<1. Orbital Angular Momentum (OAM)>

Before describing an antenna device, a communication system, and the like according to an embodiment, descriptions are given to orbital angular momentum (OAM) as basic properties of an electromagnetic wave or a radio wave. A mode of orbital angular momentum (OAM) of an electromagnetic wave is specified by a quantum number L having integer values (L=0, ±1, ±2, . . . ). An electromagnetic wave of the orbital angular momentum (OAM) having a quantum number of L has orbital angular momentum of $Lh/(2\pi)$ per photon. The h is a Planck constant. The quantum number L indicates an extent of rotation of a phase of an electromagnetic wave on a surface vertical to a direction of travel of the electromagnetic wave. When the quantum number L of the orbital angular momentum (OAM) of the electromagnetic wave is 0 (L=0), an amplitude direction of the electromagnetic field (for example, an amplitude direction of an electric field) on a surface vertical to a direction of travel of the electromagnetic wave is stable at an arbitrary time and in an arbitrary place and the phase of the electromagnetic wave does not change. That is, when the quantum number L of the orbital angular momentum (OAM) of the electromagnetic wave is 0, the electromagnetic wave is a linearly polarized wave or a circularly polarized wave. In a case of a circularly polarized wave, the amplitude direction of the electromagnetic field on the surface vertical to the direction of travel rotates in right hand rotation or left hand rotation with the travel of the electromagnetic wave, and when focusing on one arbitrary time and one arbitrary place, the amplitude direction of the electromagnetic field is stable and the phase of the electromagnetic wave is stable on the vertical surface.

When the quantum number L of the orbital angular momentum (OAM) is 1 (L=1), the phase of the electromagnetic wave changes by, for example, $2\pi$ radians (or 360 degrees) in left hand rotation on the surface vertical to the direction of travel. When the quantum number L of the orbital angular momentum (OAM) is −1 (L=−1), the phase of the electromagnetic wave changes by, for example, $2\pi$ radians (or 360 degrees) in right hand rotation on the surface vertical to the direction of travel. It is to be noted, though, that L=+1 does not have to correspond to left hand rotation and L=−1 does not have to correspond to right hand rotation, and whether to be left or right and to be positive or negative is arbitrary. The left hand rotation may also be referred to as counterclockwise rotation, and the right hand rotation may also be referred to as clockwise rotation. In general, when the quantum number of the orbital angular momentum (OAM) of the electromagnetic wave is L, the phase of the electromagnetic wave changes by $2\pi L$ radians (or 360L degrees) in a certain rotation direction (for example, right hand rotation) on the surface vertical to the direction of travel. In order to generate an electromagnetic wave having predetermined orbital angular momentum (OAM), it is possible to use, for example, an OAM filter.

FIG. 1 illustrates a situation that an electromagnetic wave emitted from a horn antenna 11 is incident on an OAM filter 12 and transmitted. The electromagnetic wave emitted from the horn antenna 11 is a linearly polarized wave or a circularly polarized wave, and the quantum number L of the orbital angular momentum (OAM) is 0. The OAM filter 12 is formed with a material transparent to an electromagnetic wave, such as quartz, glass, and crystal, and includes a surface (a front surface or a back surface) processed in a predetermined shape as described with reference to FIG. 2. The electromagnetic wave travels along a z axis and passes through the surface processed in the predetermined shape when being transmitted through the OAM filter 12, thereby changing the condition of the orbital angular momentum (OAM) of the electromagnetic wave. In the illustrated example, the quantum number L of the orbital angular momentum (OAM) changes from 0 to 1.

When an electromagnetic wave having a quantum number of orbital angular momentum (OAM) of 1 is transmitted through the OAM filter 12 illustrated in FIG. 1, the quantum number of the orbital angular momentum (OAM) of the electromagnetic wave changes from 1 to 2. This is because the extent of rotating the phase increases due to the transmission through the OAM filter 12. In general, when an electromagnetic wave having a quantum number of orbital angular momentum (OAM) of LA is transmitted through the OAM filter 12 that changes the quantum number of the orbital angular momentum (OAM) by LB, the quantum number of the orbital angular momentum (OAM) of the electromagnetic wave changes from LA to LA+LB.

Figure 2:
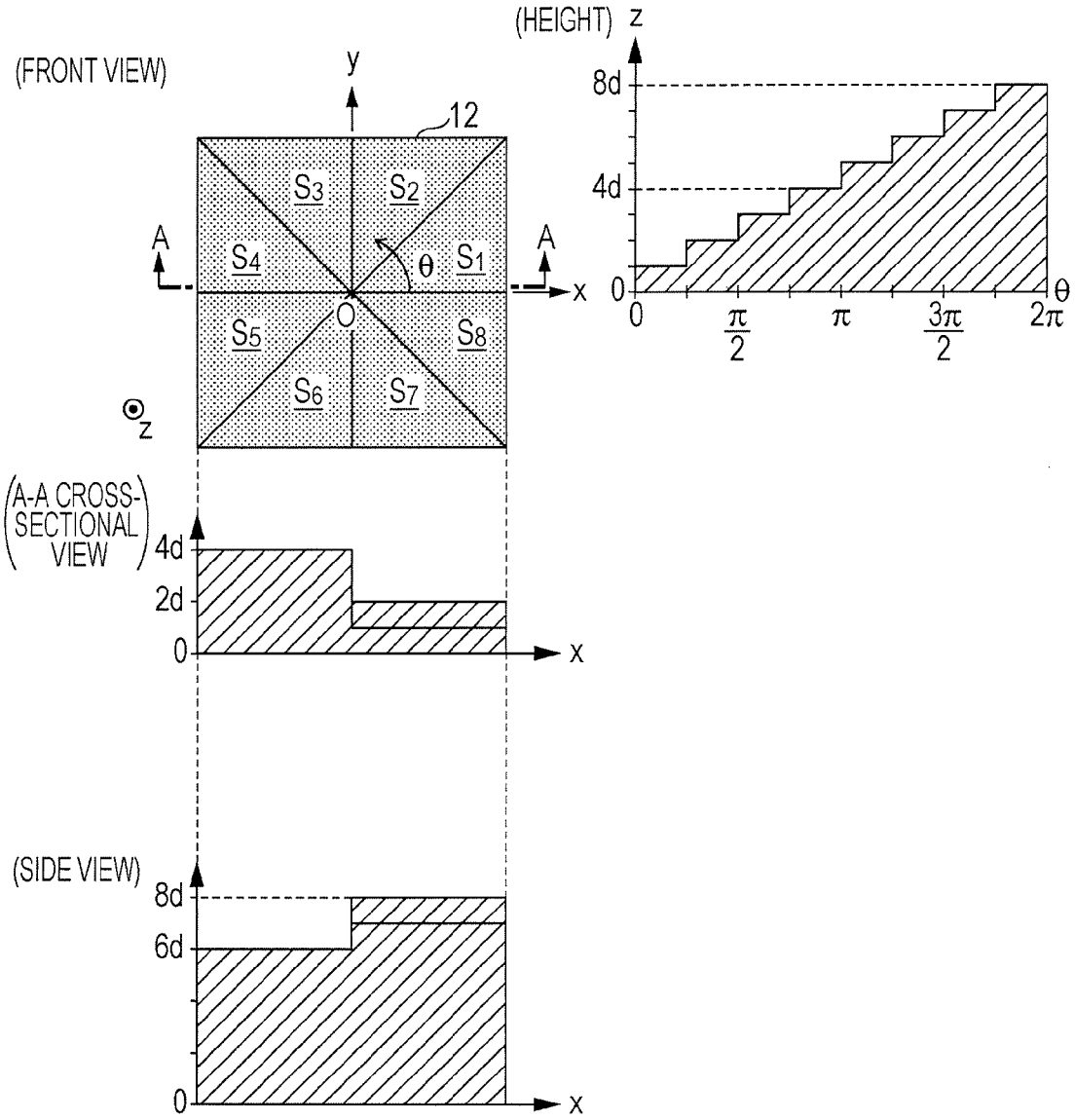
FIG. 2 illustrates one example of the OAM filter.

FIG. 2 illustrates one example of the OAM filter 12 illustrated in FIG. 1 from the perspective of a front view, a cross-sectional view taken along line A-A, a side view, and surface height. As illustrated in the front view of FIG. 2, the OAM filter 12 has a quadrilateral shape on an xy surface, and the quadrilateral shape is divided equally into eight regions $S_1$ to $S_8$. Each of the eight regions $S_1$ to $S_8$ has different thicknesses. Specifically, the regions $S_1$ to $S_8$ have thicknesses from d to 8d, respectively. In the front view of FIG. 2, when an angle to an x axis is $\theta$ and the angle $\theta$ changes from 0 to $2\pi$ radians (or 360 degrees), the thickness increases by d every time the angle $\theta$ changes by $\pi/4$ radians (or 45 degrees). That is, a surface (a front surface or a back surface) of the OAM filter illustrated in the front view of FIG. 2 has a height that changes by a level difference of d in a spiral staircase shape.

Figure 3:
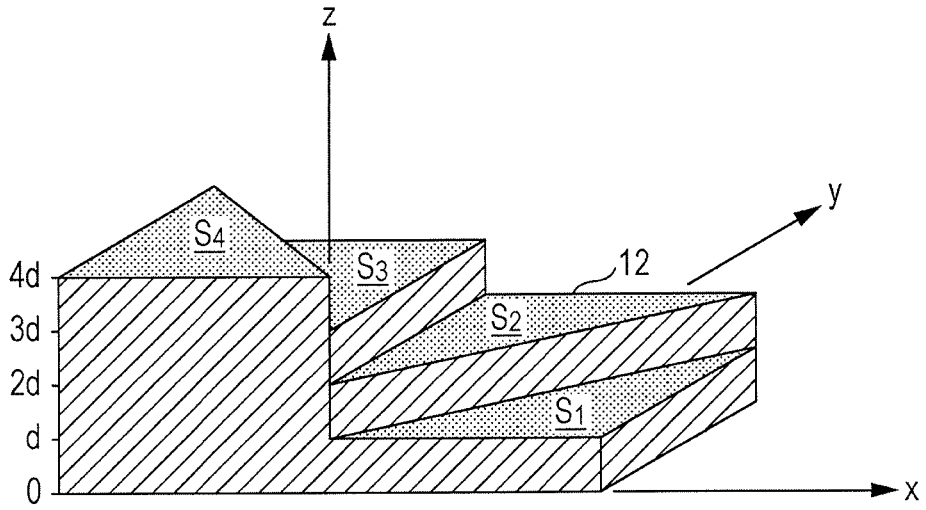
FIG. 3 is a perspective view illustrating a part of the OAM filter.

The cross-sectional view taken along line A-A in FIG. 2 illustrates thicknesses for the four regions $S_1$ to $S_4$. The shape of the OAM filter 12 illustrated in FIG. 1 corresponds to the cross-sectional view taken along line A-A in FIG. 2. The side view of FIG. 2 illustrates thicknesses of other four regions $S_5$ to $S_8$. FIG. 3 illustrates a perspective view for the four regions $S_1$ to $S_4$.

An electromagnetic wave that is transmitted through different regions among the eight regions $S_1$ to $S_8$ of the OAM filter illustrated in FIGS. 2 and 3 has phases in accordance with the different thicknesses. For example, an electromagnetic wave that is transmitted through the region $S_1$ is transmitted through a thickness of d and an electromagnetic wave that is transmitted through the region $S_2$ is transmitted through a thickness of 2d, so that the electromagnetic wave having been transmitted through the region $S_1$ and the electromagnetic wave having been transmitted through the region $S_2$ have the phases shifted by an amount in accordance with the difference in thickness (2d−d=d). Accordingly, when the level difference is set in such a manner that the shift in phase (phase difference) $\Delta\phi$ becomes $\pi/4$, the electromagnetic wave having been transmitted through the respective eight regions $S_1$ to $S_8$ has phases different by $\pi/4$, and the phases of the electromagnetic wave change by $8\times\Delta\phi=8\times\pi/4=2\pi$ radians (or 360 degrees) on the surface vertical to the direction of travel. This indicates that the quantum number L of the orbital angular momentum (OAM) of the transmitted wave is 1 (L=1). In addition, when the level difference d is set in such a manner that the phase difference $\Delta\phi$ is $\pi/2$, in a case that the electromagnetic wave is transmitted through each of the eight regions $S_1$ to $S_8$, the phase of the electromagnetic wave turns out to change $8\times\Delta\phi=8\times\pi/2=2\times2\pi$ radians (or 2×360 degrees). This indicates that the quantum number L of the orbital angular momentum (OAM) of the transmitted wave is 2 (L=2).

Figure 4:
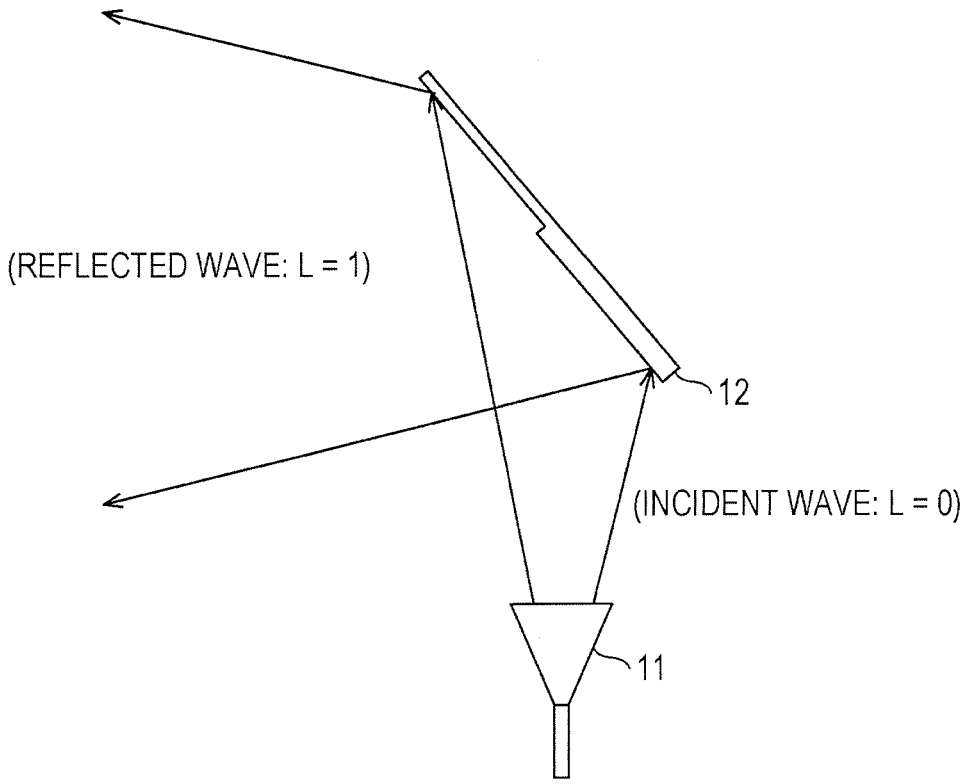
FIG. 4 illustrates a situation that an electromagnetic wave emitted from the horn antenna is reflected by the OAM filter.

Further, it is also possible to achieve orbital angular momentum (OAM) of a negative quantum number by reversing the manner of increasing and decreasing the thickness in the individual regions. Alternatively, when the direction of travel of an electromagnetic wave relative to the OAM filter is reversed, the change in the quantum number of the orbital angular momentum (OAM) is also reversed. For example, in FIG. 1, when the electromagnetic wave is transmitted through the OAM filter while traveling in the positive direction of the z axis, the quantum number of the orbital angular momentum (OAM) changes from 0 to 1. On the contrary, when the electromagnetic wave is transmitted through the OAM filter while traveling in the negative direction of the z axis, the quantum number of the orbital angular momentum (OAM) changes from 1 to 0. The relationship between the direction of travel of the electromagnetic wave and the manner of changing the quantum number also holds when the electromagnetic wave emitted from the horn antenna 11 is reflected by the OAM filter 12 as illustrated in FIG. 4. It is thus possible to generate an electromagnetic wave having desired orbital angular momentum (OAM) by appropriately setting the thickness of the OAM filter through which the electromagnetic wave is transmitted.

In the example illustrated in FIG. 2, the orbital angular momentum (OAM) of the electromagnetic wave is changed by transmitting the electromagnetic wave through the OAM filter, whereas the orbital angular momentum (OAM) of the electromagnetic wave may also be changed by reflecting the electromagnetic wave as illustrated in FIG. 4. In addition, although the OAM filter 12 illustrated in the front view of FIG. 2 has a quadrilateral shape, it may also be in a shape other than a quadrilateral shape. For example, the shape of the front view of the OAM filter 12 may also be circular.

Figure 5:
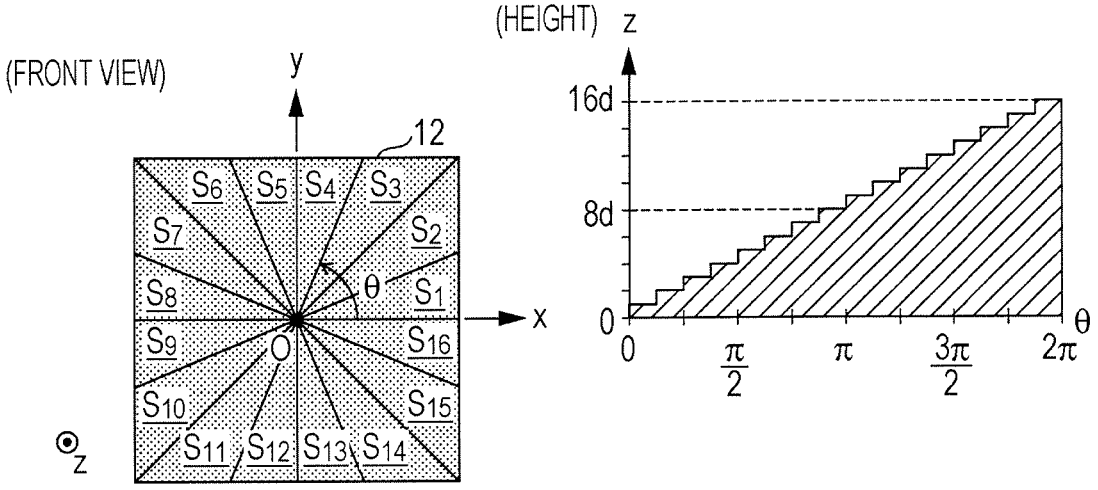
FIG. 5 illustrates a situation that the OAM filter is divided into 16 regions having different thicknesses.
Figure 6:
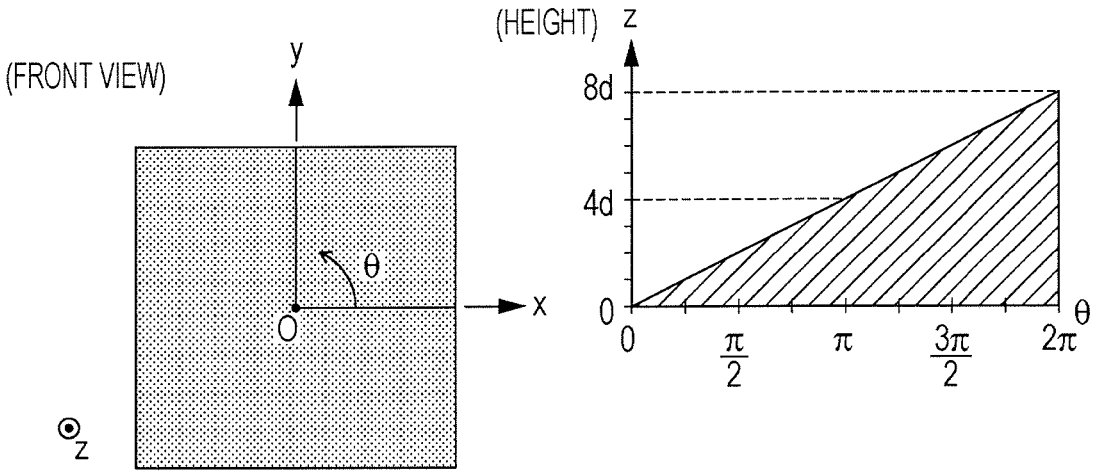
FIG. 6 illustrates an example that a surface of the OAM filter continuously changes at a predetermined gradient in a spiral slide shape.

Although, in the example illustrated FIGS. 2 and 3, the OAM filter is divided into the eight regions having different thicknesses, the dividing number may also be any appropriate value. For example, as illustrated in FIG. 5, the OAM filter may also be divided into 16 regions having different thicknesses. When the dividing number or the total number of regions is large, the number of types of phases to be set becomes large, which allows achievement of accurate phase rotation of the electromagnetic wave, so that it is preferred from the perspective of enhancing resistance to disturbance, such as interference and noises, and the like. From such a perspective, as illustrated in FIG. 6, a surface of the OAM filter may also have continuously changing heights at a predetermined gradient or slope in a spiral slide shape. In a case of the example illustrated in FIG. 6, the gradient is $4d/\pi$. Meanwhile, when the dividing number or the total number of regions is large, there is a concern that design and manufacturing procedure for such a surface becomes complex and the costs increase. On the contrary, when the dividing number or the total number of regions is small, the number of types of phase to be set becomes small and it becomes difficult to accurately achieve phase rotation of the electromagnetic wave, so that there is a concern that the resistance to disturbance, such as interference and noises, turns out to be reduced. Accordingly, the dividing number or the total number of regions has to be actually determined considering at least the resistance to disturbance and the complexity of design and manufacture.

Although, in the examples illustrated from FIGS. 1 through 6, the level difference or the slope is provided in spiral only in one surface of the OAM filter 12, level differences or slopes are provided in spiral in both front and back surfaces in embodiments described later.

<2. Antenna Device>

<<2.1 Antenna Device>>

Figure 7:
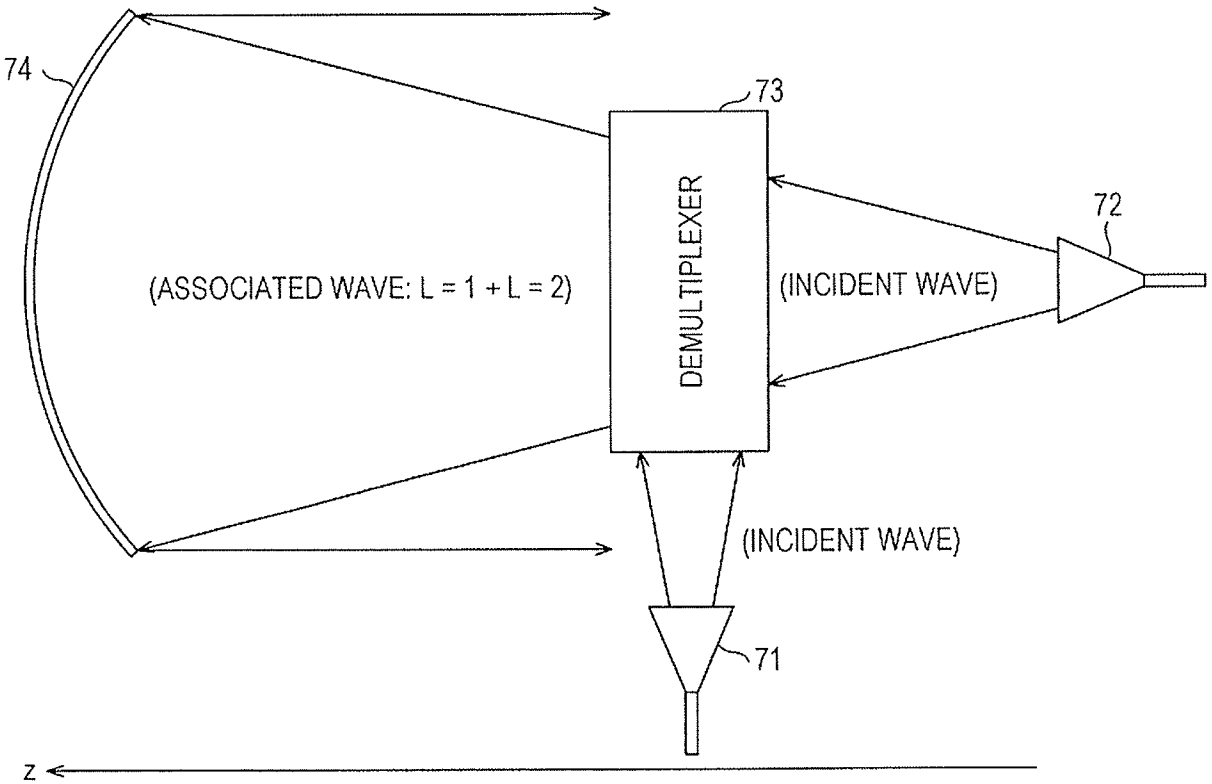
FIG. 7 illustrates an antenna device according to an embodiment.

FIG. 7 illustrates an antenna device 70 according to an embodiment. The antenna device 70 includes a first primary antenna 71, a second primary antenna 72, a demultiplexer 73, and a secondary antenna 74. For the antenna device 70, any appropriate structure may be used in accordance with the application of communication. As one example, the antenna device 70 may form a Cassegrain antenna, a Gregorian antenna, an offset parabolic antenna, an off-axis parabolic antenna, a horn reflector antenna, and the like while not limited to them. The antenna device may be used for any appropriate communication application, and may also be used for, as one example, satellite communication.

The first primary antenna 71 may be any appropriate antenna that emits an electromagnetic wave to be sent. As one example, the first primary antenna 71 may be formed as a small antenna by a horn antenna or a dipole antenna. The electromagnetic wave emitted from the first primary antenna may be a radio wave at any appropriate frequency or wavelength. As one example, the electromagnetic wave emitted from the first primary antenna may be a microwave. As one example, the quantum number L of the orbital angular momentum (OAM) of the electromagnetic wave emitted from the first primary antenna is 0 and the electromagnetic wave is a linearly polarized wave or a circularly polarized wave. It is to be noted, though, that the quantum number L of the orbital angular momentum (OAM) of the electromagnetic wave emitted from the first primary antenna 71 does not have to be 0 and an electromagnetic wave having orbital angular momentum (OAM) of a quantum number different from 0 may also be emitted from the first primary antenna 71.

The second primary antenna 72 may also be any appropriate antenna that emits an electromagnetic wave to be sent. As one example, the second primary antenna 72 may also be formed as a small antenna by a horn antenna or a dipole antenna. The electromagnetic wave emitted from the second primary antenna may also be a radio wave at any appropriate frequency or wavelength. As one example, the electromagnetic wave emitted from the second primary antenna may also be a microwave. As one example, the quantum number L of the orbital angular momentum (OAM) of the electromagnetic wave emitted from the second primary antenna is 0, and the electromagnetic wave is a linearly polarized wave or a circularly polarized wave. It is to be noted, though, that the quantum number L of the orbital angular momentum (OAM) of the electromagnetic wave emitted from the second primary antenna 72 does not have to be 0 and an electromagnetic wave having orbital angular momentum (OAM) of a quantum number different from 0 may also be emitted from the second primary antenna 72. The z axis illustrated in FIG. 7 is along a direction of travel of the electromagnetic wave emitted from the second primary antenna 72.

Although details of the demultiplexer 73 are described later, the demultiplexer 73 multiplexes the electromagnetic wave emitted from the first primary antenna 71 and the electromagnetic wave emitted from the second primary antenna 72 to output as an associated wave. The "multiplex" in this case is synonymous to "superimpose" or "associate". The demultiplexer 73 converts the electromagnetic wave emitted from the first primary antenna 71 to an electromagnetic wave in which the quantum number L of the orbital angular momentum (OAM) is changed by L1 (in the example illustrated in FIG. 7, converts a quantum number of 0 to 1). The demultiplexer 73 converts the electromagnetic wave emitted from the second primary antenna 72 to an electromagnetic wave in which the quantum number L of the orbital angular momentum (OAM) is changed by L2 (in the example illustrated in FIG. 7, converts a quantum number of 0 to 2). It is to be noted, though, that the quantum number of the orbital angular momentum (OAM) of the electromagnetic wave after the quantum number L is changed by L1 has to be different from the quantum number of the orbital angular momentum (OAM) of the electromagnetic wave after the quantum number L is changed by L2. In the example illustrated in FIG. 7, the outputted associated wave is an electromagnetic wave in which an electromagnetic wave of the orbital angular momentum (OAM) having a quantum number L of 1 is superimposed to an electromagnetic wave of the orbital angular momentum (OAM) having a quantum number L of 2.

The secondary antenna 74 may also be any appropriate device that directs the associated wave outputted from the demultiplexer 73 in a direction of a receiving antenna device that is not illustrated in FIG. 7. As one example, the secondary antenna 74 may be formed by a parabolic antenna. In this case, the second primary antenna 72 is provided at a position of a focal point of the parabolic antenna, and the secondary antenna 74 has a radius or an opening greater than the primary antennas 71 and 72. In the example illustrated in FIG. 7, the secondary antenna 74 functions as a reflecting device to reflect the associated wave outputted from the demultiplexer 73 in a direction of the receiving antenna device.

The antenna device 70 illustrated in FIG. 7 multiplexes the electromagnetic wave emitted from the first primary antenna 71 and the electromagnetic wave emitted from the second primary antenna 72 by the demultiplexer 73 to output as an associated wave. The associated wave includes an electromagnetic wave of the orbital angular momentum (OAM) having a quantum number L of 1 and an electromagnetic wave of the orbital angular momentum (OAM) having a quantum number L of 2. The associated wave is sent to the receiving antenna device by the secondary antenna 74.

On the receiving side, a process opposite to that on the sending side is carried out. It is also possible to use the antenna device as illustrated in FIG. 7 on the receiving side. When the direction of travel of the electromagnetic wave relative to the demultiplexer becomes opposite, the manner of changing the quantum number becomes opposite. Accordingly, the receiving antenna device is capable of separating the electromagnetic wave received in the secondary antenna 74 into an electromagnetic wave corresponding to the quantum number 1 of the orbital angular momentum (OAM) and an electromagnetic wave corresponding to the quantum number 2 of the orbital angular momentum (OAM) by the demultiplexer 73.

In such a manner, when used for a sending antenna device, the demultiplexer 73 functions as a device to multiplex the electromagnetic waves while changing the orbital angular momentum (OAM) of the electromagnetic waves. In contrast, when used for a receiving antenna device, the demultiplexer 73 functions as a device to separate an electromagnetic wave while changing the orbital angular momentum (OAM) of the electromagnetic wave.

<<2.2 Demultiplexer>>

Figure 8:
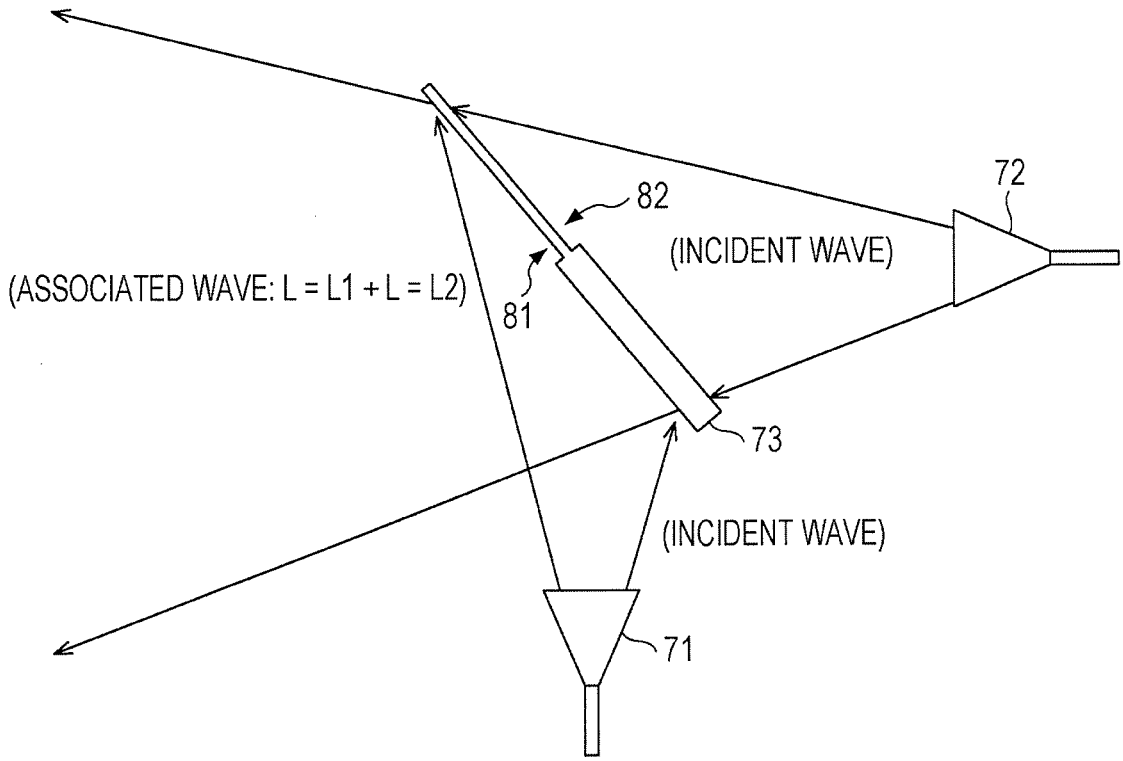
FIG. 8 illustrates a demultiplexer.

FIG. 8 illustrates relationship between the demultiplexer 73 and the first and second primary antennas 71 and 72 illustrated in FIG. 7. The demultiplexer 73 is a dielectric formed with a material transparent to an electromagnetic wave, such as quartz, glass, and crystal, and includes one surface forming a half mirror and also front and back surfaces processed in a predetermined shape as described with reference to FIG. 9 and the like. The electromagnetic wave emitted from the first primary antenna 71 is incident on a first surface 81 of the demultiplexer 73 and reflected by the first surface 81. Before and after the reflection, the quantum number L of the orbital angular momentum (OAM) of the electromagnetic wave incident on the first surface 81 changes by L1. The electromagnetic wave emitted from the second primary antenna 72 is incident on a second surface 82 of the demultiplexer 73 and is transmitted to the side of the first surface 81. Before and after the transmission, the quantum number L of the orbital angular momentum (OAM) of the electromagnetic wave incident on the second surface 82 changes by L2. Accordingly, the electromagnetic wave having the quantum number L of the orbital angular momentum (OAM) changed by L1 and the electromagnetic wave having the quantum number L of the orbital angular momentum (OAM) changed by L2 are multiplexed, thereby generating an associated wave. The associated wave is outputted from the first surface 81. Since electromagnetic waves having different orbital angular momentum (OAM) hardly interfere with each other, it is possible to carry out multiplex communication by sending the associated wave in a transmission path.

When the demultiplexer 73 is used for a receiving antenna device, a process opposite to that on the sending side is carried out. When the direction of travel of the electromagnetic wave relative to the demultiplexer becomes opposite, the manner of changing the quantum number becomes opposite. Accordingly, when reflecting a part of the received radio wave in the first surface 81, the demultiplexer 73 on the receiving side changes the quantum number of the orbital angular momentum (OAM) of the electromagnetic wave by −L1 (for example, changes from L1 to 0) to obtain one of the multiplexed electromagnetic waves. In addition, when the electromagnetic wave is incident on the first surface 81 and transmitted through the second surface 82, the demultiplexer 73 on the receiving side changes the quantum number of the orbital angular momentum (OAM) of the electromagnetic wave by −L2 (for example, changes from L2 to 0) to obtain the other multiplexed electromagnetic wave.

Accordingly, the demultiplexer 73 according to the embodiment is also capable of exhibiting a function as an OAM filter that changes the quantum number of the orbital angular momentum (OAM) of the electromagnetic wave in addition to the function as a half mirror that reflects and transmits the electromagnetic wave. Therefore, the device to reflect and transmit an electromagnetic wave in FIG. 7 and the like is referred to as a "demultiplexer" not as an "OAM filter". The demultiplexer 73 according to the embodiment has a half mirror and an OAM filter integrated therein, so that it is possible to reduce the number of parts from the past that provided a half mirror and an OAM filter separately.

For example, when two electromagnetic waves are multiplexed in a technique in the past, there have to be two horn antennas to generate an electromagnetic wave, two OAM filters to change orbital angular momentum (OAM) of an individual electromagnetic wave, one half mirror to multiplex an electromagnetic wave, and one antenna (for example, parabolic antenna). Only to multiplex two electromagnetic waves for sending, there have to be at least six parts. Moreover, there have to be similarly many parts on the receiving side that carries out a process corresponding to that on the sending side. In contrast, according to the embodiment, when multiplexing two electromagnetic waves, there may be provided with two horn antennas to generate an electromagnetic wave and a demultiplexer to have a half mirror and an OAM filter integrated therein, in which there have to be only three parts.

Figure 9:
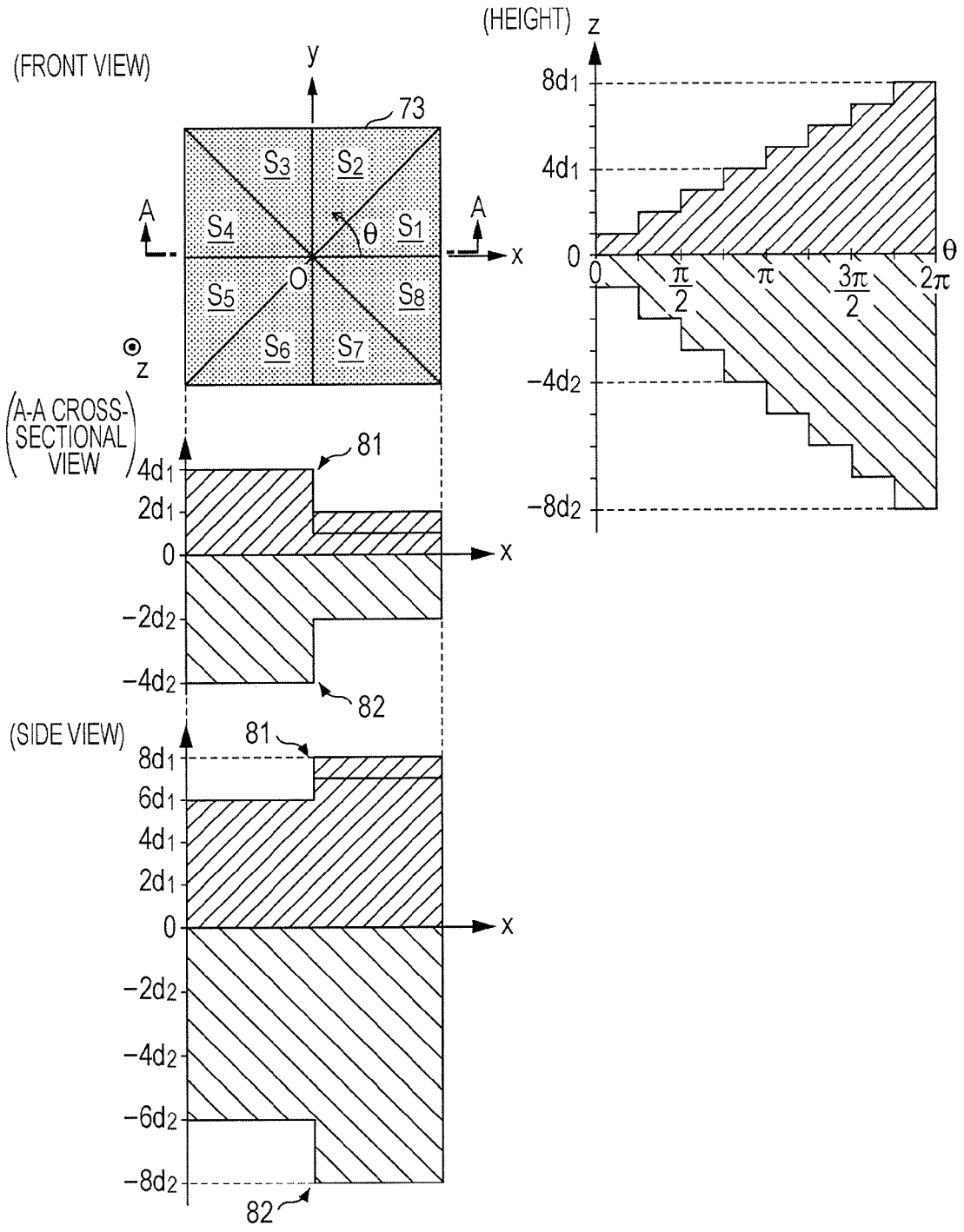
FIG. 9 illustrates one example of the demultiplexer.

FIG. 9 illustrates one example of the demultiplexer 73 illustrated in FIG. 7 and FIG. 8 from the perspective of a front view, a cross-sectional view taken along line A-A, a side view, and surface height. As illustrated in the front view of FIG. 9, the demultiplexer 73 has a quadrilateral shape on an xy surface, and the quadrilateral shape is divided equally into eight regions $S_1$ to $S_8$. Each of the eight regions $S_1$ to $S_8$ has a different thickness. Different from the example illustrated in FIG. 2, the regions $S_1$ to $S_8$ have thicknesses from $(d_1+d_2)$ to $8(d_1+d_2)$, respectively. In the front view of FIG. 9, when the angle to an x axis is 0 and the angle θ changes from 0 to 2π radians (or 360 degrees), the thickness increases by $(d_1+d_2)$ every time the angle θ changes by π/4 radians (or 45 degrees). Different from the example illustrated in FIG. 2, the demultiplexer 73 illustrated in FIGS. 8 and 9 has a height that changes by a predetermined level difference d in a spiral staircase shape on both front and back surfaces. The first surface 81 has a height that increases by a first level difference $d_1$ in spiral along a direction leaving from the second surface 82 or the xy plane (in a plus direction of the z axis). The second surface 82 has a height that decreases by a second level difference $d_2$ in spiral along a direction leaving from the first surface 81 or the xy plane (in a minus direction of the z axis).

Figure 10:
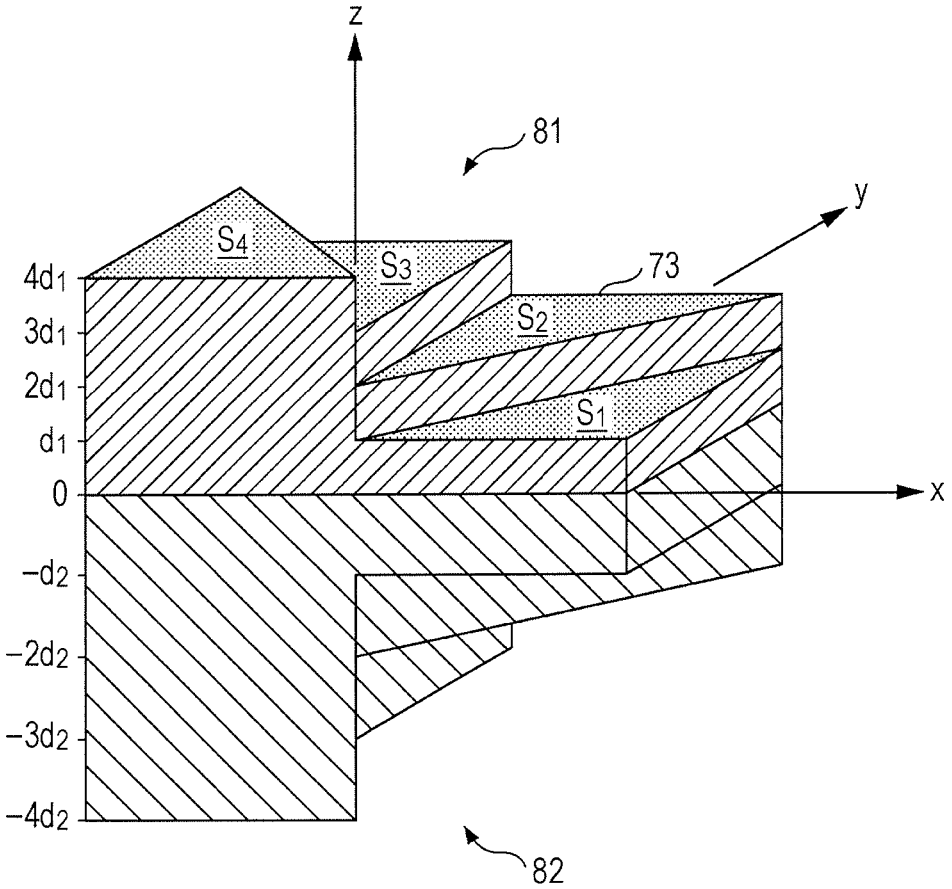
FIG. 10 is a perspective view illustrating a part of the demultiplexer.

The cross-sectional view taken along line A-A in FIG. 9 illustrates thicknesses for the four regions $S_1$ to $S_4$. The shape of the demultiplexer 73 illustrated in FIG. 8 corresponds to the cross-sectional view taken along line A-A in FIG. 9. The side view of FIG. 9 illustrates thicknesses of the other four regions $S_5$ to $S_8$. FIG. 10 illustrates a perspective view for the four regions $S_1$ to $S_4$.

<<2.3 Method of Determining Level Difference>>

[Method of Determining Level Difference $d_1$]

Electromagnetic waves reflected from each of the eight regions $S_1$ to $S_8$ of the demultiplexer illustrated in FIGS. 9 and 10 have phases in accordance with the level difference $d_1$. For example, an electromagnetic wave when an electromagnetic wave (L=0) is incident on the region $S_1$ of the first surface 81 from a z axis +∞ direction (vertical direction) to be reflected travels excessively by the distance of $2d_1$ due to the outbound and the inbound more than an electromagnetic wave when an electromagnetic wave (L=0) is incident on the region $S_2$ of the first surface 81 from the z axis +∞ direction (vertical direction) to be reflected. When the optical path difference in this case equals to the phase difference $\Delta\phi_1=2\pi/8(=\pi/4)$, the electromagnetic wave reflected from each of the regions $S_1$ to $S_8$ has a phase different by π/4 respectively and a total of the phase differences of the entire eight regions $S_1$ to $S_8$ becomes $\pi/4\times8=2\pi$ (radians). Accordingly, the quantum number L of the orbital angular momentum (OAM) of the electromagnetic wave incident on the first surface 81 changes by +1 or −1 by being reflected by the first surface 81. Accordingly, it is possible to obtain the level difference $d_1$ to change the quantum number by ±1 as follows.

$$k\times2d_1=2\pi/8$$

$$\therefore d_1=\lambda/16,$$

wherein k denotes a wavenumber and equals to 2π/λ, and λ denotes a wavelength of the electromagnetic wave. When the total number of regions is not 8 but N (N is an integer of 2 or more) and the amount of change in the quantum number of the orbital angular momentum (OAM) is L, it is possible to obtain the level difference $d_1$ as follows.

$$k\times2d_1=2\pi L/N$$

$$\therefore d_1=L\lambda/(2N)$$

Further, when the electromagnetic wave incident on the first surface 81 makes an angle α to the axis vertical to the xy plane, the optical path difference becomes $k\times2d_1\cos\alpha$, so that it is possible to obtain the level difference $d_1$ as follows.

$$k\times2d_1\cos\alpha=2\pi L/N$$

$$\therefore d_1=L\lambda/(2N\cos\alpha).$$

[Method of Determining Level Difference $d_2$]

Next, in FIGS. 8 through 10, a discussion is given to determine the level difference $d_2$ of the second surface 82 so as to change the quantum number of the orbital angular momentum (OAM) of the electromagnetic wave incident from the second surface 82, transmitted through the demultiplexer 73, and outputted from the first surface 81 by a predetermined value. In this case, among the electromagnetic waves incident from the second surface 82 for transmission, a part goes out from the first surface 81 to outside the demultiplexer 73 while another part is reflected on the first surface 81 to come back towards the second surface 82. Among the electromagnetic waves coming back, a part goes out from the second surface 82 to outside the demultiplexer 73 while another part is reflected on the second surface 82 to travel towards the first surface 81. Accordingly, the level difference $d_2$ has to be actually determined appropriately considering multiple reflection inside the demultiplexer 73 as well.

However, from the perspective of qualitative simplified description, the discussion is given by assuming that such multiple reflection does not occur inside the demultiplexer 73. As illustrated in FIGS. 9 and 10, the second surface 82 also has a height that decreases by the second level difference $d_2$ in spiral along a direction leaving from the first surface 81 or the xy plane (in a minus direction of the z axis). As illustrated in the graph of relationship between z (height or thickness) and the angle (8) in FIG. 9, the regions $S_1$ to $S_8$ respectively have thicknesses from $(d_1+d_2)$ to $8(d_1+d_2)$. When traveling (or being transmitted or propagating) inside the demultiplexer 73, it takes time more than a case of traveling in atmosphere. This is because, when an electromagnetic wave travels in a medium (demultiplexer 73) having a refractive index of n, an apparent distance (optical distance) becomes n times of the actual distance. It is possible to express the refractive index n as $n=\sqrt{\in_r}$. The $\in_r$ is a dielectric constant $\in_r$ of the medium (demultiplexer 73).

Accordingly, when a discussion is given to a phase of an electromagnetic wave that is transmitted through the demultiplexer 73, the wavenumber of the electromagnetic wave that travels in the air has to be $k=2\pi/\lambda$, while the wavenumber of the electromagnetic wave that travels inside the demultiplexer 73 has to be $k'=2\pi/(\lambda/n)$. It is possible to express the phase difference between the electromagnetic wave that is transmitted through the region $S_1$ and the electromagnetic wave that is transmitted through the region $S_2$ as the following formula when assuming that multiple reflection does not occur inside the demultiplexer 73.

$$k'(d_1+d_2)-k(d_1+d_2)=2\pi/(\lambda/n)\times(d_1+d_2)-2\pi/\lambda\times(d_1+d_2)$$

The first member on the left hand side and the right hand side denotes a phase when traveling inside the medium (demultiplexer 73) having a thickness of $(d_1+d_2)$, and the second member denotes a phase when traveling by a distance of $(d_1+d_2)$ outside the demultiplexer 73 (in the air). When the optical path difference or the phase difference in this case is $\pi/4$, the electromagnetic waves that are transmitted through the respective eight regions $S_1$ to $S_8$ have the phases different by $\pi/4$ each, and the total of the phase difference of the entire eight regions $S_1$ to $S_8$ becomes $\pi/4\times8=2\pi$ (radians). Accordingly, the quantum number L of the orbital angular momentum (OAM) of the electromagnetic wave that has been transmitted from the second surface 82 to the first surface 81 changes by +1 or −1 by being transmitted inside the demultiplexer 73 from the second surface 82 to the first surface 81. Accordingly, it is possible to obtain the level difference $d_2$ to change the quantum number by ±1 as follows.

$$2\pi/(\lambda/n)\times(d_1+d_2)-2\pi/\lambda\times(d_1+d_2)=2\pi/8$$

$$\therefore d_2=\lambda/(8(n-1))-d_1$$

When the total number of regions is not 8 but N (N is an integer of 2 or more) and the amount of change in the quantum number of the orbital angular momentum (OAM) is L, it is possible to obtain the level difference $d_2$ as follows.

$$2\pi/(\lambda/n)\times(d_1+d_2)-2\pi/\lambda\times(d_1+d_2)=2\pi L/N$$

$$\therefore d_2=L\lambda/(N(n-1))-d_1$$

Further, when the electromagnetic wave is transmitted from the second surface 82 to the first surface 81, an incident angle relative to the axis vertical to the xy surface is a and an angle of refraction is β, and it is possible to express the phase difference between the electromagnetic wave that is transmitted through a medium having a thickness of $(d_1+d_2)$ and goes out and the electromagnetic wave that travels in the air as follows.

$$2\pi/(\lambda/n)\times(d_1+d_2)/\cos\beta-2\pi/\lambda\times\cos(\alpha-\beta)/\cos\beta$$

When this phase difference is $2\pi L/N$, the quantum number of the orbital angular momentum (OAM) of the electromagnetic wave having been transmitted through each of the N regions changes by ±L. It is possible to obtain the level difference $d_2$ in this case as follows.

$$2\pi/(\lambda/n)\times(d_1+d_2)/\cos\beta-2\pi/\lambda\times\cos(\alpha-\beta)/\cos\beta=2\pi L/N$$

$$\therefore d_2=(\lambda/N)/((n^2-\sin^2\alpha)^{1/2}-\cos\alpha)-d_1$$

Figure 11:
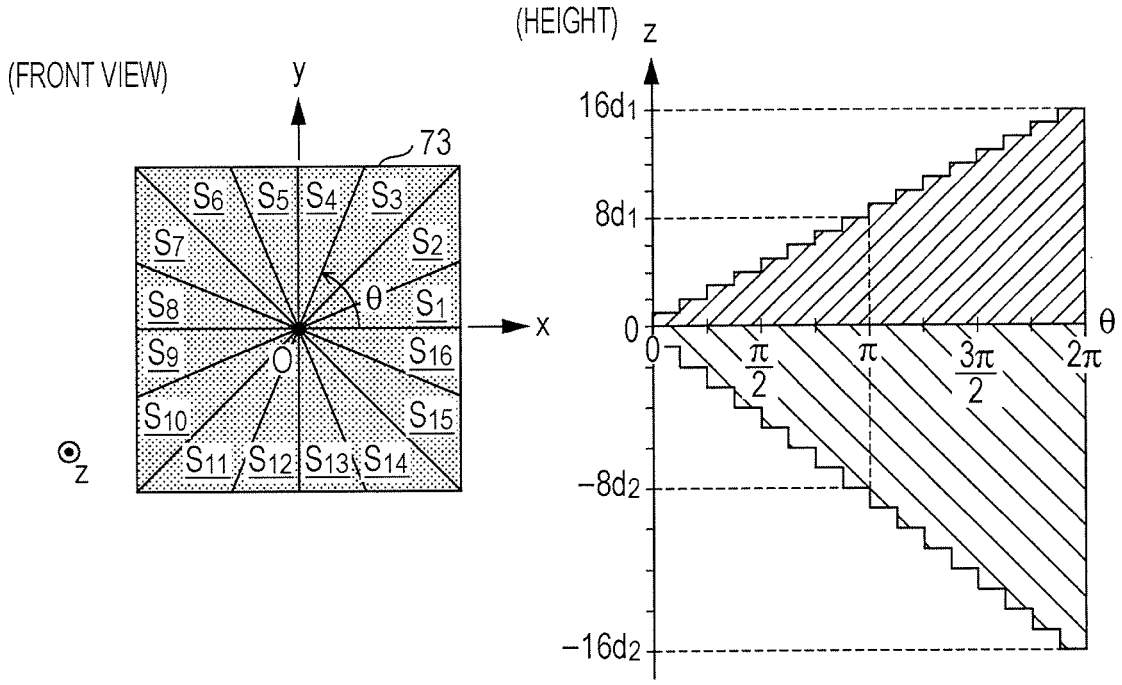
FIG. 11 illustrates a situation that the demultiplexer is divided into 16 regions having different thicknesses.
Figure 12:
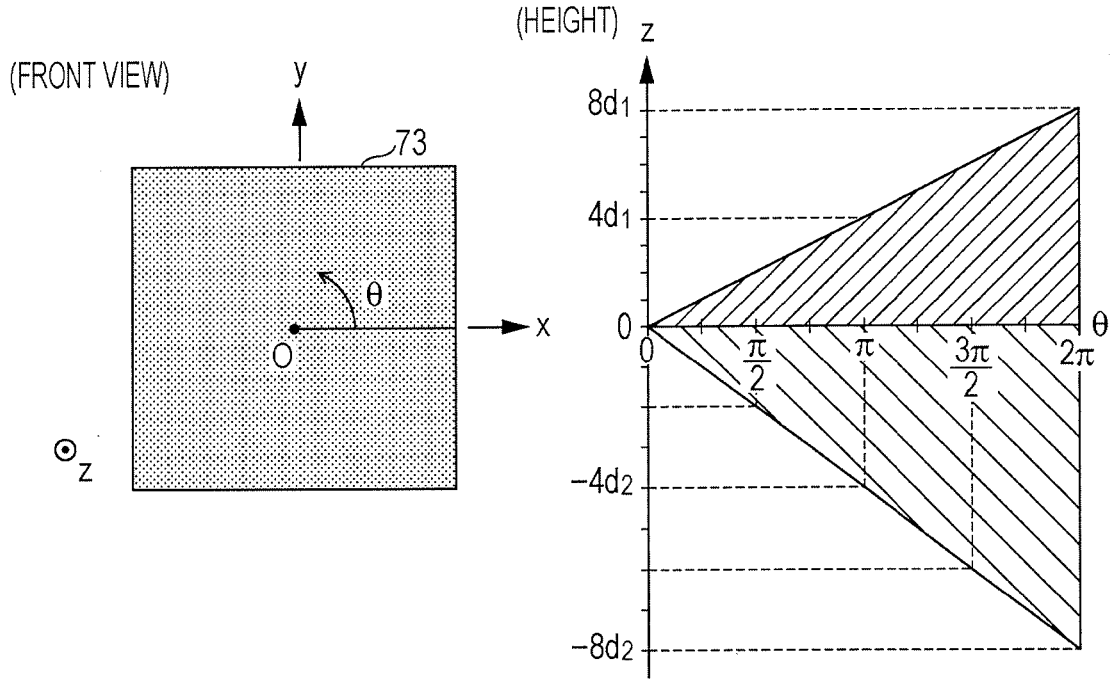
FIG. 12 illustrates an example that a surface of the demultiplexer continuously changes at a predetermined gradient in a spiral slide shape.

Although, in the example illustrated in FIGS. 9 and 10, the demultiplexer 73 is divided into eight regions having different thicknesses, the dividing number may be any appropriate value. For example, as illustrated in FIG. 11, the demultiplexer 73 may also be divided into 16 regions having different thicknesses. When the dividing number or the total number of regions is large, the number of types of phases to be set becomes large, which allows achievement of accurate phase rotation of the electromagnetic wave, so that it is preferred from the perspective of enhancing resistance to disturbance, such as interference and noises, and the like. From such a perspective, as illustrated in FIG. 12, the first surface 81 of the demultiplexer 73 may also have continuously changing heights at a predetermined gradient or slope in a spiral slide shape and the second surface 82 of the demultiplexer 73 may also have continuously changing heights at a predetermined gradient or slope in a spiral slide shape. In a case of the example illustrated in FIG. 12, the gradient on the first surface 81 is $+4d_1/\pi$ and the gradient on the second surface 82 is $-4d_1/\pi$. Meanwhile, when the dividing number or the total number of regions is large, there is a concern that design and manufacturing procedure for such a surface becomes complex and the costs increase. On the contrary, when the dividing number or the total number of regions is small, the number of types of phases to be set becomes small and it becomes difficult to accurately achieve phase rotation of the electromagnetic wave, so that there is a concern that the resistance to disturbance, such as interference and noises, turns out to be reduced. Accordingly, the dividing number or the total number of regions has to be actually determined considering at least the resistance to disturbance and the complexity of design and manufacture.

In the example illustrated in FIGS. 9 through 12, the thickness in each region of the demultiplexer 73 (distance between the first surface 81 and the second surface 82) increases by $d_1+d_2$ every time the angle made with the x axis increases $\pi/4$ (or 45 degrees). However, embodiments are not limited to this example.

Figure 13:
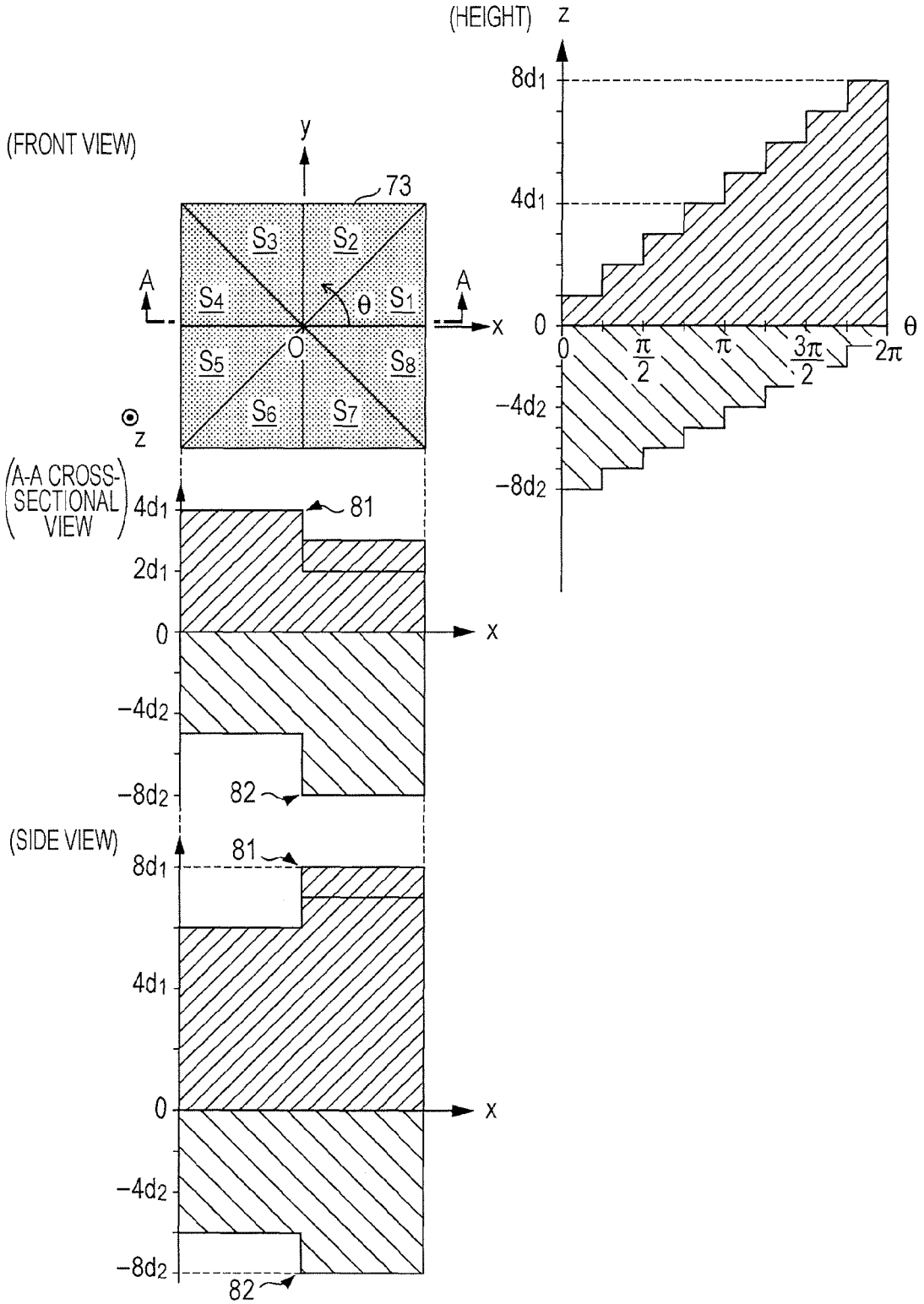
FIG. 13 illustrates one example of the demultiplexer.

FIG. 13 illustrates another example of the demultiplexer 73 from the perspective of a front view, a cross-sectional view taken along line A-A, a side view, and surface height. As illustrated in the front view of FIG. 13, the demultiplexer 73 has a quadrilateral shape on an xy surface, and the quadrilateral shape is divided equally into eight regions $S_1$ to $S_8$. Each of the eight regions $S_1$ to $S_8$ has a different thickness. The regions $S_1$ to $S_8$ have thicknesses from $(d_1+8d_2)$ to $(8d_1+d_2)$, respectively. For example, the thickness of the region $S_1$ is $d_1+8d_2$ and the thickness of the region $S_2$ is $2d_1+7d_2$, and the difference in thickness Δ is $d_1-d_2$. In the front view of FIG. 13, when the angle to an x axis is θ and the angle θ changes from 0 to 2π radians (or 360 degrees), the thickness increases by $(d_1-d_2)$ every time the angle θ changes by $\pi/4$ radians (or 45 degrees). The demultiplexer 73 has a height that changes by a predetermined level difference d in a spiral staircase shape on both front and back surfaces. The first surface 81 has a height that increases by a first level difference $d_1$ in spiral along a direction leaving from the second surface 82 or the xy plane (in a plus direction of the z axis). The second surface 82 also has a height that increases by a second level difference $d_2$ in spiral in the plus direction of the z axis.

Figure 14:
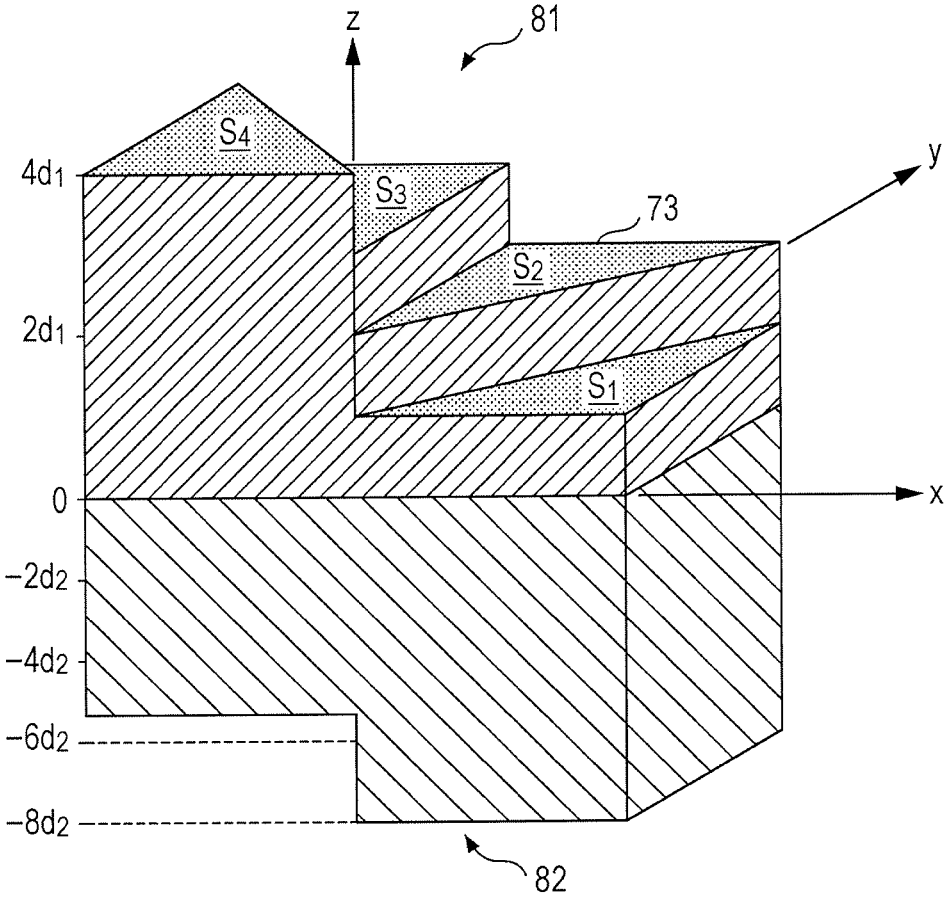
FIG. 14 is a perspective view illustrating a part of the demultiplexer.

The cross-sectional view taken along line A-A in FIG. 13 illustrates thicknesses for the four regions $S_1$ to $S_4$. It is to be noted in the point that the shape illustrated in a cross-sectional view taken along line A-A of FIG. 13 is different from the shape illustrated in the cross-sectional view taken along line A-A of FIG. 9. The side view of FIG. 13 illustrates thicknesses of the other four regions $S_5$ to $S_8$. FIG. 14 illustrates a perspective view for the four regions $S_1$ to $S_4$.

Figure 15:
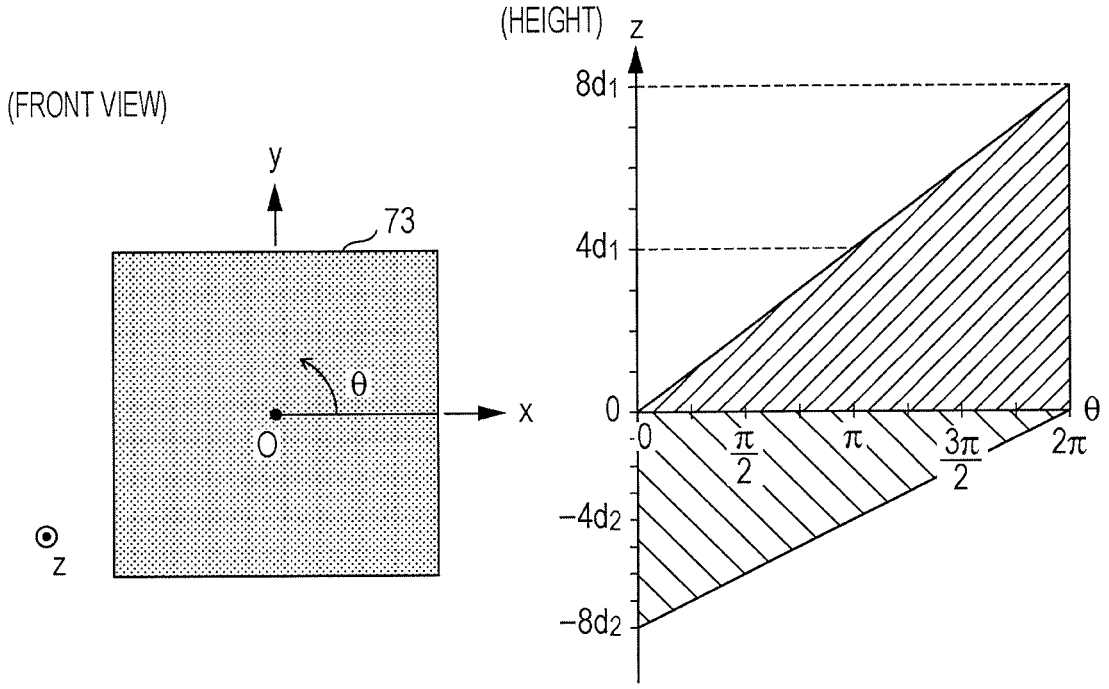
FIG. 15 illustrates an example that a surface of the demultiplexer continuously changes at a predetermined gradient in a spiral slide shape.

Further, as illustrated in FIG. 15, the first surface 81 of the demultiplexer 73 may also have continuously changing heights at a predetermined gradient or slope in a spiral slide shape, and the second surface 82 of the demultiplexer 73 may also have continuously changing heights at a predetermined gradient or slope in a spiral slide shape. In a case of the example illustrated in FIG. 15, the gradient on the first surface 81 is $+4d_1/\pi$, and the gradient on the second surface 82 is $+4d_2/\pi$.

In a case of the example illustrated FIGS. 13 and 14, it is possible to determine the level difference $d_1$ on the first surface 81 similarly as described in "2.3 Method of determining level difference [Method of determining level difference $d_1$]". It is possible to similarly obtain the level difference $d_2$ on the second surface 82 by replacing the thickness of the medium (demultiplexer 73) "$d_1+d_2$" with "$d_1-d_2$".

When the thickness of each region in the demultiplexer 73 increases and decreases by $d_1-d_2$, descriptions are given to a case of $d_1=d_2$ in "5. Triple multiplex (part 2)".

<3. Communication System>

Figure 16:
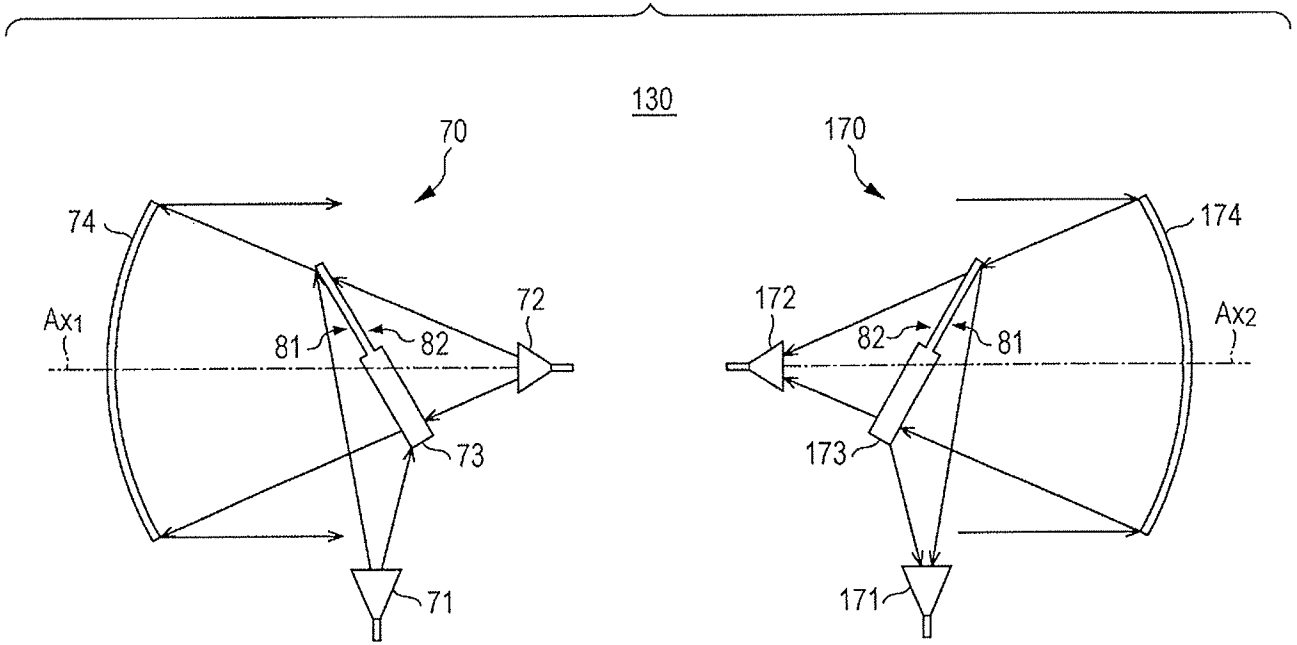
FIG. 16 illustrates a communication system using the demultiplexer according to the embodiment.

It is possible to use the demultiplexer 73 illustrated in FIGS. 7 through 12 for the sending side and the receiving side. FIG. 16 illustrates a communication system using such a demultiplexer. A communication system 130 includes the sending antenna device 70 and a receiving antenna device 170. Similarly as described with reference to FIG. 7, the antenna device 70 has the first primary antenna 71, the second primary antenna 72, the demultiplexer 73, and the secondary antenna 74. The antenna device 170 has a first primary antenna 171, a second primary antenna 172, a demultiplexer 173, and a secondary antenna 174.

Each of the first and second primary antennas 71 and 72 may be any appropriate antenna that emits an electromagnetic wave to be sent. As one example, the first and second primary antennas 71 and 72 may be formed by a horn antenna or a dipole antenna. The electromagnetic wave emitted from the first and second primary antennas 71 and 72 may be a radio wave at any appropriate frequency or wavelength. As one example, the electromagnetic wave emitted from the first and second primary antennas 71 and 72 may be a microwave. As one example, the quantum number L of the orbital angular momentum (OAM) of the electromagnetic wave emitted from the first and second primary antennas is 0 and the electromagnetic wave is a linearly polarized wave or a circularly polarized wave. It is to be noted, though, that the quantum number L of the orbital angular momentum (OAM) of the electromagnetic wave emitted from the first and second primary antennas 71 and 72 does not have to be 0 and an electromagnetic wave having orbital angular momentum (OAM) of a quantum number different from 0 may also be emitted from the first and second primary antennas 171 and 172.

The demultiplexer 73 multiplexes the electromagnetic wave emitted from the first primary antenna 71 and the electromagnetic wave emitted from the second primary antenna 72 to output as an associated wave. The demultiplexer 73 converts the electromagnetic wave emitted from the first primary antenna 71 to an electromagnetic wave in which the quantum number L of the orbital angular momentum (OAM) is changed by L1. The demultiplexer 73 converts the electromagnetic wave emitted from the second primary antenna 72 to an electromagnetic wave in which the quantum number L of the orbital angular momentum (OAM) is changed by L2. In order to allow exhibition of such conversion function, a front and a back of the demultiplexer 73 are defined by the first surface 81 and the second surface 82. The first surface 81 has a height that changes in spiral as leaving from the second surface 82 or the xy plane in such a manner that the quantum number of the orbital angular momentum (OAM) of the electromagnetic wave changes by L1 before and after the reflection of the electromagnetic wave. The second surface 82 has a height that changes in spiral as leaving from the second surface 82 or the xy plane in such a manner that the quantum number of the orbital angular momentum (OAM) of the electromagnetic wave changes by L2 before and after the transmission of the electromagnetic wave. It is to be noted, though, that the quantum number of the orbital angular momentum (OAM) of the electromagnetic wave after the quantum number L is changed by L1 has to be different from the quantum number of the orbital angular momentum (OAM) of the electromagnetic wave after the quantum number L is changed by L2. In the example illustrated in FIG. 16, the associated wave is an electromagnetic wave in which an electromagnetic wave of the orbital angular momentum (OAM) having a quantum number L changed by L1 (for example, L=0->L1) is superimposed to an electromagnetic wave of the orbital angular momentum (OAM) having a quantum number L changed by L2 (for example, L=0->L2).

The secondary antenna 74 may also be any appropriate device that sends the associated wave outputted from the demultiplexer 73 to the receiving antenna device 170. As one example, the secondary antenna 74 may be formed by a parabolic antenna. In this case, the second primary antenna 72 is provided at a position of a focal point of the parabolic antenna, and the secondary antenna 74 has a radius or an opening greater than the primary antennas 71 and 72. In the example illustrated in FIG. 16, the secondary antenna 74 functions as a reflecting device to reflect the associated wave outputted from the demultiplexer 73 in a direction of the receiving antenna device.

The secondary antenna 174 may also be any appropriate device that receives the associated wave and sends to the demultiplexer 173. As one example, the secondary antenna 174 may be formed by a parabolic antenna. In this case, the second primary antenna 172 is provided at a position of a focal point of the parabolic antenna, and the secondary antenna 174 has a radius or an opening greater than the primary antennas 171 and 172. In the example illustrated in FIG. 16, the secondary antenna 174 functions as a reflecting device to reflect the received electromagnetic wave (associated wave) in a direction of the demultiplexer 173.

The demultiplexer 173 generates an electromagnetic wave having a quantum number of the orbital angular momentum (OAM) of a part of the electromagnetic wave among the electromagnetic waves received in the secondary antenna 174 changed by L1 to give to the first primary antenna 171. In addition, the demultiplexer 173 generates an electromagnetic wave having a quantum number of the orbital angular momentum (OAM) of another part of the electromagnetic wave among the electromagnetic waves received in the secondary antenna 174 changed by L2 to give to the second primary antenna 172. The demultiplexer 173 may have the same configuration as the demultiplexer 73. This is because, when the direction of travel of the electromagnetic wave becomes opposite, the manner of changing the quantum number becomes opposite. As one example, an electromagnetic wave having the quantum number L1 of the orbital angular momentum (OAM) of a part of the electromagnetic wave among the electromagnetic waves received in the secondary antenna 174 changed to 0 may also be generated to give to the first primary antenna 171. In addition, the quantum number L2 of the orbital angular momentum (OAM) of another part of the electromagnetic wave among the electromagnetic waves received in the secondary antenna 174 changed to 0 may also be generated to give to the second primary antenna 172.

In FIG. 16, a central axis $Ax_1$ through the center of the secondary antenna 74 and the demultiplexer 73 on the sending side has to appropriately match a central axis $Ax_2$ through the center of the secondary antenna 174 and the demultiplexer 173 on the receiving side. In this case, when the front and back surfaces of the demultiplexers 73 and 173 are formed as illustrated in FIGS. 9 through 15, a change in the quantum number of the orbital angular momentum (OAM) does not easily occur as intended in an electromagnetic wave that is reflected or transmitted near the central axis (near the original point in the xy surface). This is because an optical path difference of electromagnetic waves due to the difference of elevation of the surfaces by the level difference or the gradient does not easily occur appropriately near the central axis and it is difficult to form a large number of types of the phase of the electromagnetic wave. Therefore, intensity of the electromagnetic wave near the central axis becomes quite weak compared with other regions. Accordingly, even when the demultiplexer 73 exists on the central axis of the sending antenna device 70, it does not interfere with the electromagnetic wave (associated wave) to be sent. In addition, even when the demultiplexer 173 exists on the central axis of the receiving antenna device 170, it does not interfere with the electromagnetic wave (associated wave) to be received.

<4. Triple Multiplex (Part 1)>

The demultiplexers described in "2. Antenna device" and "3. Communication system" multiplex and separate two electromagnetic waves having different orbital angular momentum (OAM). However, embodiments are not limited to the example to multiplex and separate two electromagnetic waves, and are applicable to a case of multiplexing and separating three or more electromagnetic waves having different orbital angular momentum (OAM).

Figure 17:
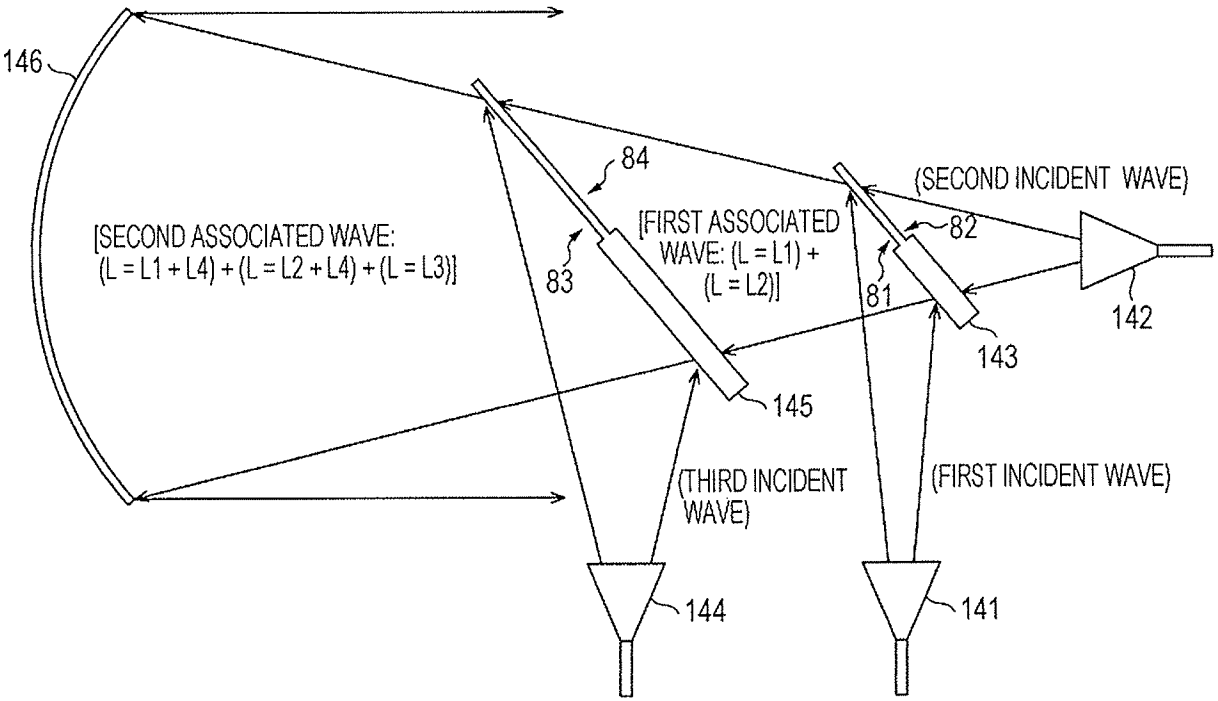
FIG. 17 illustrates an antenna device to multiplex three electromagnetic waves having different orbital angular momentum (OAM)

FIG. 17 illustrates an antenna device 140 that sends an associated wave in which three electromagnetic waves having different orbital angular momentum (OAM) are multiplexed. The antenna device 140 has a first primary antenna 141, a second primary antenna 142, a first demultiplexer 143, a third primary antenna 144, a second demultiplexer 145, and a secondary antenna 146.

Similar to the antenna device illustrated in FIG. 7, any appropriate structure may also be used for the antenna device 140 illustrated in FIG. 17 in accordance with the communication applications. As one example, the antenna device 140 may form a Cassegrain antenna, a Gregorian antenna, an offset parabolic antenna, an off-axis parabolic antenna, a horn reflector antenna, and the like while not limited to them. The antenna device may be used for any appropriate communication application, and may also be used for, as one example, satellite communication.

The first, second, and third primary antennas 141, 142, and 144 may be any appropriate antennas that emit an electromagnetic wave to be sent. As one example, each of the first, second, and third primary antennas 141, 142, and 144 may be formed by a horn antenna or a dipole antenna. The electromagnetic wave emitted from each of the first, second, and third primary antennas 141, 142, and 144 may be a radio wave at any appropriate frequency or wavelength. As one example, the electromagnetic wave emitted from each of the first, second, and third primary antennas 141, 142, and 144 may be a microwave. As one example, the quantum number L of the orbital angular momentum (OAM) of the electromagnetic wave emitted from each of the first, second, and third primary antennas 141, 142, and 144 is 0 and the electromagnetic wave is a linearly polarized wave or a circularly polarized wave. It is to be noted, though, that the quantum number L of the orbital angular momentum (OAM) of the electromagnetic wave emitted from each of the first, second, and third primary antennas 141, 142, and 144 does not have to be 0 and an electromagnetic wave having orbital angular momentum (OAM) of a quantum number different from 0 may also be emitted from each of the first, second, and third primary antennas 141, 142, and 144.

The first demultiplexer 143 is similar to the demultiplexer described with reference to FIGS. 7 through 16. A front and a back of the first demultiplexer 143 are defined by the first surface 81 and the second surface 82. The first surface 81 has a height that changes in spiral as leaving from the second surface 82 or the xy plane in such a manner that the quantum number of the orbital angular momentum (OAM) of the electromagnetic wave changes by L1 before and after the reflection of the electromagnetic wave. The second surface 82 has a height that changes in spiral as leaving from the second surface 82 or the xy plane in such a manner that the quantum number of the orbital angular momentum (OAM) of the electromagnetic wave changes by L2 before and after the transmission of the electromagnetic wave.

The demultiplexer 143 multiplexes the electromagnetic wave emitted from the first primary antenna 141 and the electromagnetic wave emitted from the second primary antenna 142 to output as a first associated wave. The demultiplexer 143 converts the electromagnetic wave emitted from the first primary antenna 141 to an electromagnetic wave in which the quantum number L of the orbital angular momentum (OAM) is changed by L1. The demultiplexer 143 converts the electromagnetic wave emitted from the second primary antenna 142 to an electromagnetic wave in which the quantum number L of the orbital angular momentum (OAM) is changed by L2. It is to be noted, though, that the quantum number of the orbital angular momentum (OAM) of the electromagnetic wave after the quantum number L is changed by L1 has to be different from the quantum number of the orbital angular momentum (OAM) of the electromagnetic wave after the quantum number L is changed by L2. The first associated wave is an electromagnetic wave in which an electromagnetic wave of the orbital angular momentum (OAM) having a quantum number L changed by L1 is superimposed to an electromagnetic wave of the orbital angular momentum (OAM) having a quantum number L changed by L2.

Although the second demultiplexer 145 is similar to the demultiplexer described with reference to FIGS. 7 through 16, a front and a back of the second demultiplexer 145 are defined by a third surface 83 and a fourth surface 84. The third surface 83 has a height that changes in spiral as leaving from the fourth surface 84 or the xy plane in such a manner that the quantum number of the orbital angular momentum (OAM) of the electromagnetic wave changes by L3 before and after the reflection of the electromagnetic wave. The fourth surface 84 has a height that changes in spiral as leaving from the third surface 83 or the xy plane in such a manner that the quantum number of the orbital angular momentum (OAM) of the electromagnetic wave changes by L4 before and after the transmission of the electromagnetic wave.

The demultiplexer 145 multiplexes the electromagnetic wave emitted from the third primary antenna 144 and the first associated wave to output as a second associated wave. The demultiplexer 145 converts the electromagnetic wave emitted from the third primary antenna 144 to an electromagnetic wave in which the quantum number L of the orbital angular momentum (OAM) is changed by L3. The demultiplexer 145 converts the first associated wave to an electromagnetic wave in which the quantum number L of the orbital angular momentum (OAM) is changed by L4. It is to be noted, though, that the quantum number of the orbital angular momentum (OAM) of the electromagnetic wave after the quantum number L is changed by L3 has to be different from the quantum number of the orbital angular momentum (OAM) of the electromagnetic wave after the quantum number L is changed by L4. In the example illustrated in FIG. 17, a second associated wave is an electromagnetic wave in which an electromagnetic wave of the orbital angular momentum (OAM) having a quantum number L of (L1+L4), an electromagnetic wave of the orbital angular momentum (OAM) having a quantum number L of (L2+L4), and an electromagnetic wave of the orbital angular momentum (OAM) having a quantum number L of L3 are superimposed.

The secondary antenna 146 may also be any appropriate device that directs the associated wave outputted from the second demultiplexer 145 in a direction of the receiving antenna device not illustrated in FIG. 17. As one example, the secondary antenna 146 may be formed by a parabolic antenna. In this case, the second primary antenna 142 is provided at a position of a focal point of the parabolic antenna, and the secondary antenna 146 has a radius or an opening greater than the primary antennas 141, 142, and 143. In the example illustrated in FIG. 17, the secondary antenna 146 functions as a reflecting device to reflect the second associated wave outputted from the second demultiplexer 125 in a direction of the receiving antenna device.

The antenna device 140 illustrated in FIG. 17 multiplexes an electromagnetic wave emitted from the first primary antenna 141 and an electromagnetic wave emitted from the second primary antenna 142 by the first demultiplexer 143 to output as a first associated wave. The first associated wave includes an electromagnetic wave of the orbital angular momentum (OAM) having a quantum number L changed by L1 and an electromagnetic wave of the orbital angular momentum (OAM) having a quantum number L changed by L2. Further, the antenna device 140 multiplexes an electromagnetic wave emitted from the third primary antenna 144 and the first associated wave to output as a second associated wave by the second demultiplexer 145. The second associated wave is an electromagnetic wave in which the electromagnetic wave of the orbital angular momentum (OAM) having a quantum number L of (L1+L4), the electromagnetic wave of the orbital angular momentum (OAM) having a quantum number L of (L2+L4), and the electromagnetic wave of the orbital angular momentum (OAM) having a quantum number L changed by L3 are superimposed. The second associated wave is sent to a receiving antenna device not illustrated in FIG. 17 by the secondary antenna 146.

On the receiving side, a process opposite to that on the sending side is carried out. It is also possible to use the antenna device as illustrated in FIG. 17 on the receiving side. This is because, when the direction of travel of the electromagnetic wave relative to the demultiplexer of the antenna device becomes opposite, the manner of changing the quantum number becomes opposite. The receiving antenna device separates the electromagnetic wave received in the secondary antenna 146 (second associated wave) into an electromagnetic wave corresponding to the quantum number L=L3 of the orbital angular momentum (OAM) of and an electromagnetic wave corresponding to the quantum number L=L1+L2 of the orbital angular momentum (OAM) by the second demultiplexer 145. Further, the receiving antenna device separates the electromagnetic wave corresponding to the quantum number of the orbital angular momentum (OAM) of L=L1+L2 into the electromagnetic wave corresponding to the quantum number of the orbital angular momentum (OAM) of L=L1 and the electromagnetic wave corresponding to the quantum number of the orbital angular momentum (OAM) of L=L2 by the first demultiplexer 143.

Although three electromagnetic waves are multiplexed and separated in the example illustrated in FIG. 17, it is also possible to multiplex and separate more electromagnetic waves having different orbital angular momentum (OAM) by increasing the number of demultiplexers.

As a specific example, it is assumed that the level difference $d_1$ of the first surface 81 is set in such a manner that the quantum number L of the orbital angular momentum (OAM) of the electromagnetic wave incident on the first surface 81 changes by L1=+1 before and after the reflection by the first surface 81 of the first demultiplexer 143. It is assumed that the level difference $d_1$ and the level difference $d_2$ are set in such a manner that the quantum number L of the orbital angular momentum (OAM) of the electromagnetic wave incident on the second surface 82 changes by L2=+2 before and after the transmission from the second surface 82 to the first surface 81. When it is assumed that both quantum numbers of the orbital angular momentum (OAM) of the electromagnetic waves emitted from the first and second primary antennas are 0, the first associated wave outputted from the first demultiplexer 143 includes an electromagnetic wave having quantum numbers L of the orbital angular momentum (OAM) of L1=1 and L2=2.

It is assumed that a level difference $d_3$ of the third surface 83 is set in such a manner that the quantum number L of the orbital angular momentum (OAM) of the electromagnetic wave incident on the third surface 83 changes by L3=+3 before and after the reflection by the third surface 83 of the second demultiplexer 145. It is assumed that the level difference $d_3$ and a level difference $d_4$ are set in such a manner that the quantum number L of the orbital angular momentum (OAM) of the electromagnetic wave incident on the fourth surface 84 changes by L4=+1 before and after the transmission from the fourth surface 84 to the third surface 83. In this case, the quantum number of the orbital angular momentum (OAM) of the electromagnetic wave reflected by the third surface 83 of the second demultiplexer 145 is L3=3. Since the quantum number of the orbital angular momentum (OAM) of the electromagnetic wave that is transmitted through the second demultiplexer 145 changes by L4=+1, the quantum numbers of the orbital angular momentum (OAM) of the electromagnetic wave included in the first associated wave of L1=1 and L2=2 change to L1=1+1=2 and L2=2+1=3, respectively. However, since the quantum number of the orbital angular momentum (OAM) of the electromagnetic wave reflected by the third surface 83 is also 3, the second associated wave is not successfully multiplexing the three electromagnetic waves appropriately. This is because all the quantum numbers of the orbital angular momentum (OAM) of the three electromagnetic waves included in the second associated wave have to be different.

With that, it is assumed that the level difference $d_3$ and the level difference $d_4$ are set in such a manner that the quantum number L of the orbital angular momentum (OAM) of the electromagnetic wave incident on the fourth surface 84 changes by L4=+3 before and after the transmission from the fourth surface 84 to the third surface 83. In this case as well, the quantum number of the orbital angular momentum (OAM) of the electromagnetic wave reflected by the third surface 83 of the second demultiplexer 145 is L3=3. Since the quantum number of the orbital angular momentum (OAM) of the electromagnetic wave that is transmitted through the second demultiplexer 145 changes by L4=+3, the quantum numbers of the orbital angular momentum (OAM) of the electromagnetic waves included in the first associated wave of L1=1 and L2=2 change to L1=1+3=4 and L2=2+3=5, respectively. Accordingly, the second associated wave outputted from the second demultiplexer 145 is successfully multiplexing the electromagnetic wave having the quantum numbers of the orbital angular momentum (OAM) of L1=4, L2=5, and L3=3 appropriately.

<5. Triple Multiplex (Part 2)>

The thickness of each of the plurality of regions of the demultiplexer described with reference to FIGS. 9 through 15 increases with the increase in the angle made to the x axis. However, it is also possible to fix the thickness of each of the plurality of regions of the demultiplexer regardless of the angle made to the x axis. This is equivalent to a case of $d_1=d_2$ in the example illustrated in FIGS. 13 through 15 where the thickness changes for each $d_1$ to $d_2$.

Figure 18:
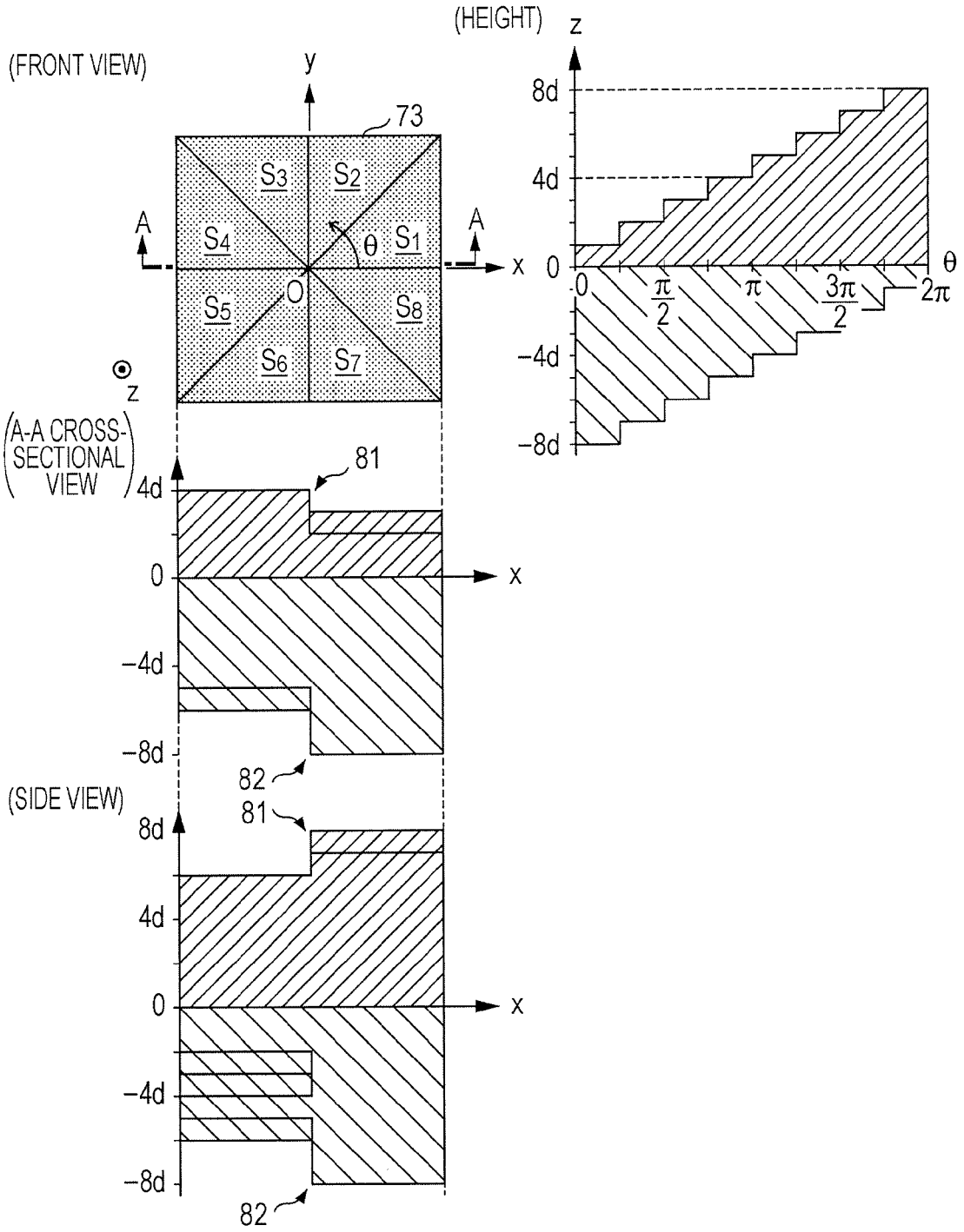
FIG. 18 illustrates one example of a demultiplexer having the same thickness in a plurality of regions.

FIG. 18 illustrates one example of a demultiplexer having the same thickness in each of a plurality of regions from the perspective of a front view, a cross-sectional view taken along line A-A, a side view, and surface height. Although the demultiplexer may be used for the demultiplexer 73, 173, 143, or 145 in FIG. 7 through FIG. 17, it is referred to as a "demultiplexer 73" for simplicity. As illustrated in the front view of FIG. 18, the demultiplexer has a quadrilateral shape on the xy surface and the quadrilateral shape is divided equally into eight regions $S_1$ to $S_8$. Each of the eight regions $S_1$ to $S_8$ has the same thickness. Specifically, in the example illustrated in FIG. 18, the thickness of each region is 9d (=d+8d).

The first surface 81 has a height that increases for each level difference d in spiral along the direction leaving from the second surface 82 or the xy plane (in a plus direction of the z axis). The second surface 82 also has a height that increases for each level difference d in spiral in the plus direction of the z axis. It is to be noted that the level difference in the second surface d, which is the same as the level difference in the first surface. When an angle to the x axis is θ and the angle θ changes from 0 to 360 degrees, the height of the first surface 81 increases in the plus direction of the z axis by d every time the angle θ changes by π/4 radians (or 45 degrees) while the height of the second surface 82 also increases in the plus direction of the z axis by d. As a result, the thickness of each region, which is the difference between the height of the first surface 81 and the height of the second surface, is maintained stably at 9d.

Figure 19:
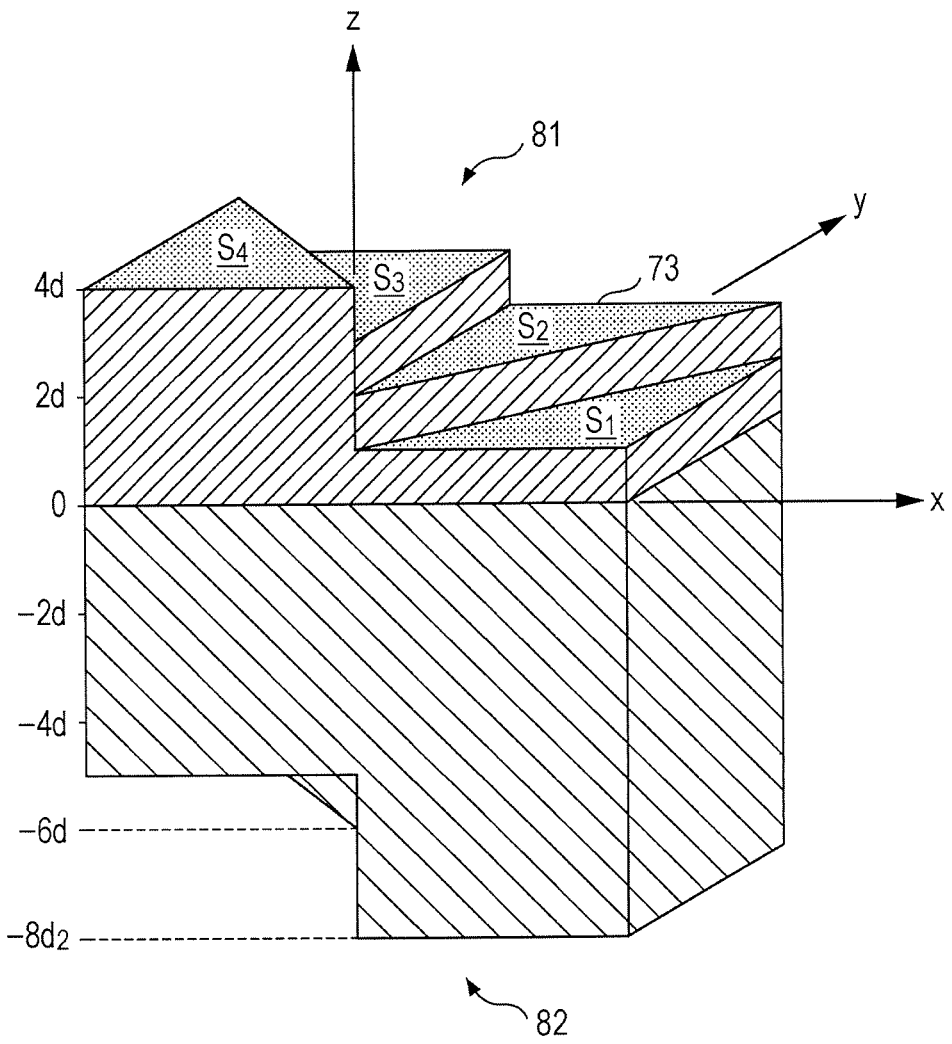
FIG. 19 is a perspective view illustrating a part of the demultiplexer.

The cross-sectional view taken along line A-A in FIG. 18 illustrates thicknesses for the four regions $S_1$ to $S_4$. The side view of FIG. 18 illustrates the thicknesses in the other four regions $S_5$ to $S_8$. FIG. 19 illustrates a perspective view for the four regions $S_1$ to $S_4$.

The first surface 81 of the demultiplexer 73 illustrated in FIGS. 18 and 19 has a height that increases by the level difference d in a spiral staircase shape in the plus direction of the z axis in such a manner that the quantum number L of the orbital angular momentum (OAM) of the electromagnetic wave changes by a predetermined value L1 before and after the reflection on the first surface 81. Although the second surface 82 also has a height d that increases in a spiral staircase shape in the plus direction of the z axis, the electromagnetic wave transmitted through the first surface 81 from the second surface 82 is transmitted through the same thickness for any of the eight regions. Since the demultiplexer 73 is equivalent to a transparent substrate having a stable thickness 9d for the transmitted electromagnetic wave, the quantum number of the orbital angular momentum (OAM) of the electromagnetic wave does not change before and after the transmission through the demultiplexer 73.

Figure 20:
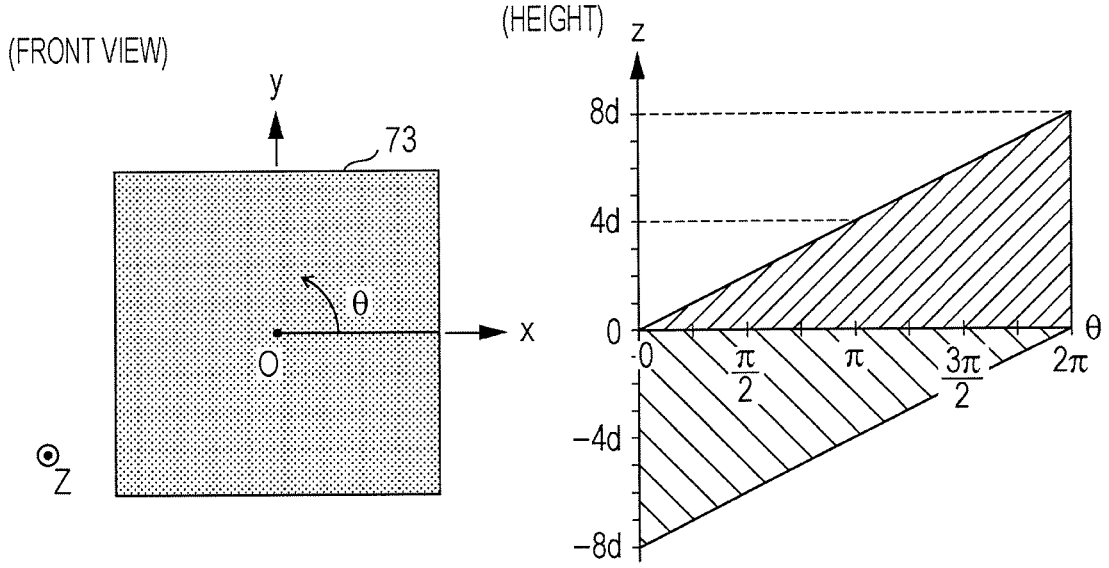
FIG. 20 illustrates an example that a surface of the demultiplexer continuously changes at a predetermined gradient in a spiral slide shape.

Although, in the example illustrated in FIGS. 18 and 19, the first surface 81 and the second surface 82 have a height that increases by the level difference d in a spiral staircase shape in the plus direction of the z axis, they may also have a height that changes in a spiral slide shape. One example of such demultiplexer 73 is illustrated in FIG. 20. The first surface 81 of the demultiplexer 73 illustrated in FIG. 20 has continuously changing heights at a predetermined gradient or slope in a spiral slide shape, and the second surface 82 of the demultiplexer 73 also has continuously changing heights at a predetermined gradient or slope in a spiral slide shape. The gradient on the first surface 81 is +4d/π, and the gradient on the second surface 82 is also +4d/π.

Figure 21:
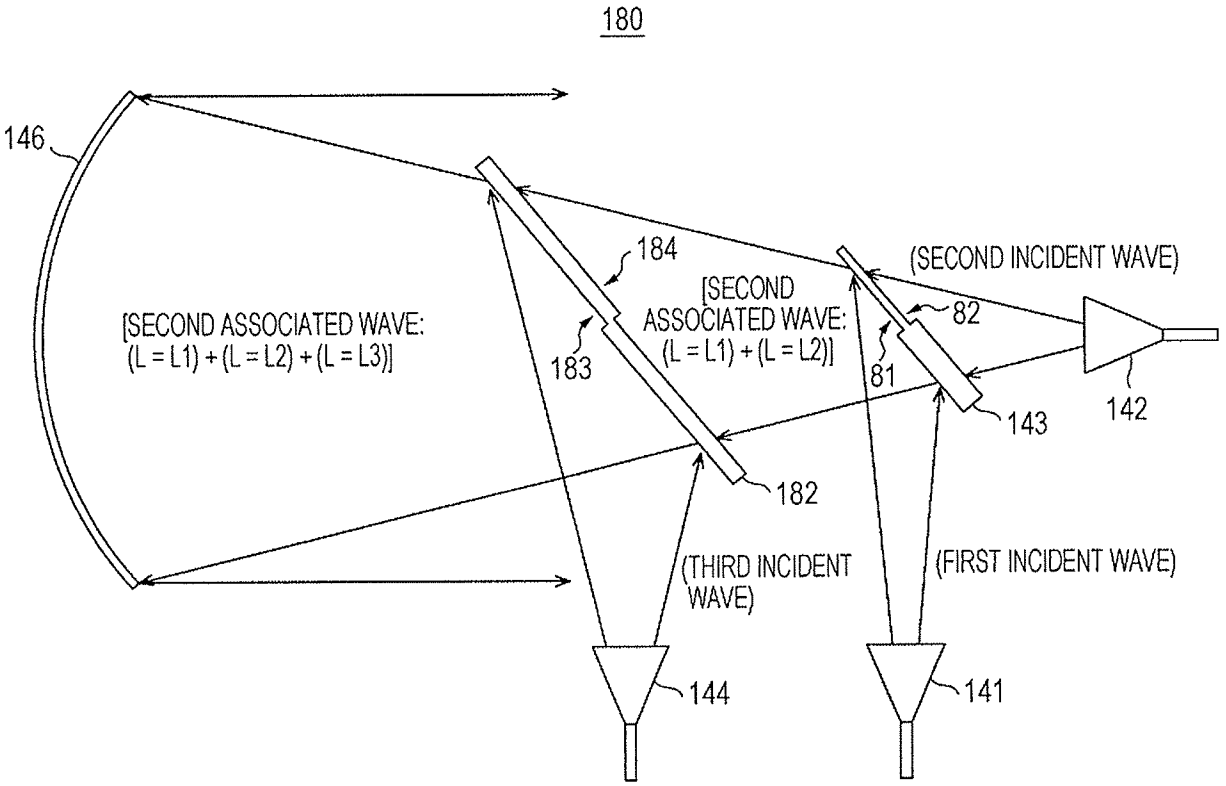
FIG. 21 illustrates another antenna device to multiplex three electromagnetic waves having different orbital angular momentum (OAM)

FIG. 21 illustrates a communication system by replacing the second demultiplexer 145 with a demultiplexer 182 having a stable thickness in each region as illustrated in FIGS. 18 through 20 in the communication system in FIG. 17. The same reference character is given to an element already described in FIG. 17 to omit repetitive description. The second demultiplexer 182 has a third surface 183 and a fourth surface 184. The third surface 183 has a height that changes by the level difference d in a spiral staircase shape in such a manner that the quantum number L of the orbital angular momentum (OAM) changes by a predetermined value L3 before and after the reflection of the electromagnetic wave on the third surface 183. Although the fourth surface 184 has the height d that changes in a spiral staircase shape, all the electromagnetic waves transmitted from the fourth surface 184 to the third surface 183 are transmitted through the same thickness 9d. Accordingly, when an electromagnetic wave is transmitted through the demultiplexer 145, the quantum number of the orbital angular momentum (OAM) does not change. The shape of the demultiplexer 182 illustrated in FIG. 21 corresponds to the cross-sectional view taken along line A-A in FIG. 18.

Similar to the description with reference to FIG. 17, it is assumed that the first associated wave outputted from the first demultiplexer 143 includes an electromagnetic wave having a quantum number L of the orbital angular momentum (OAM) of L1=1 and L2=2. It is assumed that the level difference d of the third surface 183 is set in such a manner that the quantum number L of the orbital angular momentum (OAM) of the electromagnetic wave incident on the third surface 183 changes by L3=+3 before and after the reflection on the third surface 183 of the second demultiplexer 182. The height of the fourth surface 184 is formed in a spiral staircase shape with the level difference d so that the quantum number L of the orbital angular momentum (OAM) of the electromagnetic wave incident on the fourth surface 184 does not change before and after the transmission from the fourth surface 184 to the third surface 183.

In this case, the quantum number of the orbital angular momentum (OAM) of the electromagnetic wave reflected by the third surface 183 of the second demultiplexer 182 is L3=3. Since the quantum number of the orbital angular momentum (OAM) of the electromagnetic wave that is transmitted through the second demultiplexer 182 does not change, the quantum numbers L1=1 and L2=2 of the orbital angular momentum (OAM) of the electromagnetic waves included in the first associated wave does not change and is outputted as L1=1 and L2=2. The second associated wave outputted from the second demultiplexer 182 is successfully multiplexing the electromagnetic waves having the quantum numbers L1=1, L2=2, and L3=3 of the orbital angular momentum (OAM) appropriately.

As described with reference to FIG. 18 through FIG. 21, it is possible to use a demultiplexer having front and back surface heights formed so as to change the quantum number of the orbital angular momentum (OAM) by a predetermined value for reflection and so as not to change the quantum number for transmission. It is also possible to use both a demultiplexer that changes the quantum number of the orbital angular momentum (OAM) both for reflection and transmission (FIG. 7 through FIG. 17) and a demultiplexer that changes the quantum number by a predetermined value for reflection and does not change the quantum number for transmission (FIGS. 18 through 21). Further, although not illustrated, it is also possible to keep the quantum number unchanged only for reflection by making the reflection surface only as a flat plane. It is preferred to allowing use of various demultiplexers in such a manner from the perspective of achieving various multiplexing manners, increasing degree of freedom in design, and the like.

<6. Modifications>

Figure 22:
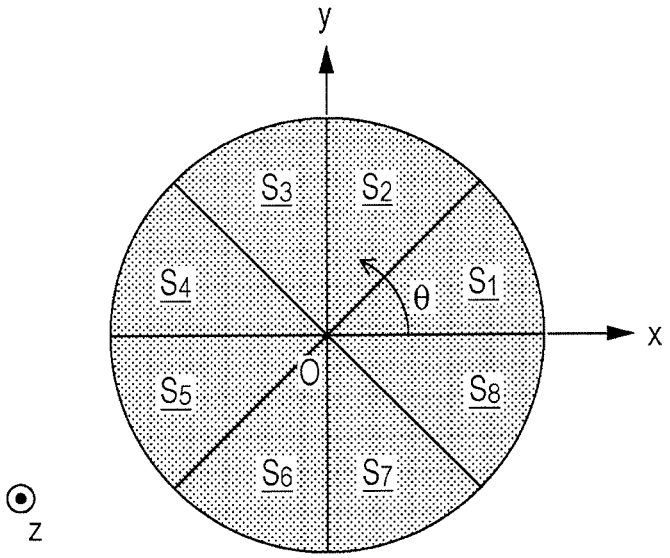
FIG. 22 illustrates one example of a demultiplexer having a circular shape.
Figure 23:
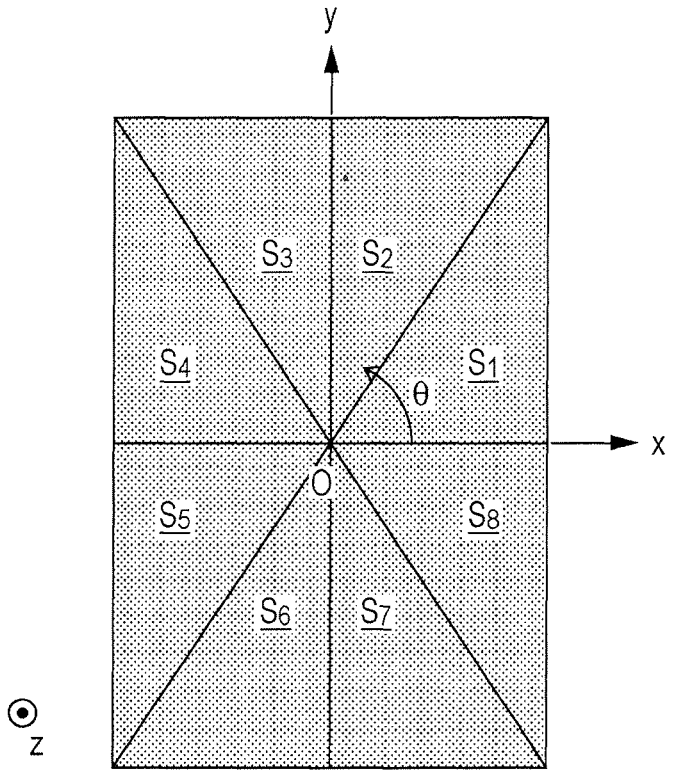
FIG. 23 illustrates one example of a demultiplexer having a rectangular shape.
Figure 24:
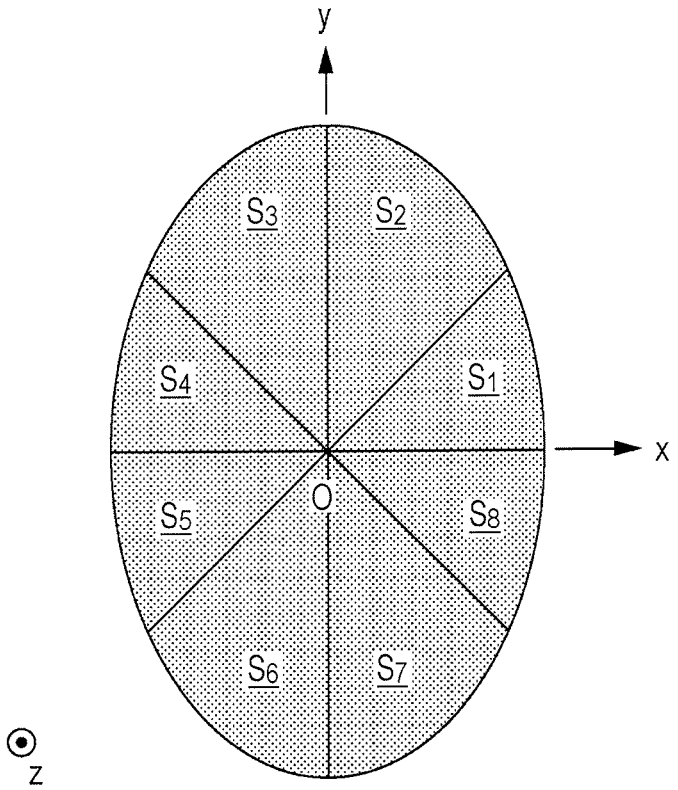
FIG. 24 illustrates one example of a demultiplexer having an elliptical shape.

Although the demultiplexers illustrated in FIG. 7 through FIG. 21 have a quadrilateral shape in a front view, this does not have to be made for embodiments and any appropriate shape to reflect and transmit an electromagnetic wave may also be used. For example, a front shape of a demultiplexer may also be circular as illustrated in FIG. 22, not quadrilateral. Further, a front shape of a demultiplexer may also be rectangular as illustrated in FIG. 23, not only square. In addition, a front shape of a demultiplexer may also be elliptical as illustrated in FIG. 24, not only circular. As illustrated in FIG. 23 and FIG. 24, it is advantageous to elongate one of the vertical or horizontal size (x axis direction or y axis direction) of the demultiplexer when using the demultiplexer inclined to the direction of traveling of the transmitted electromagnetic wave (z axis direction) as illustrated in FIG. 8, FIG. 16, FIG. 17, and FIG. 21. This is because the demultiplexer in these cases receives an electromagnetic wave spread radially or symmetrically on the surface vertical to the direction of travel of the electromagnetic wave on the slope surface relative to the direction of travel. As one example, when the demultiplexer is sloped at 45 degrees relative to the direction of travel of the transmitted electromagnetic wave, the long side of the rectangular shape illustrated in FIG. 23, may be $\sqrt{2}$ times of the short side. Similarly, when the demultiplexer is sloped at 45 degrees relative to the direction of travel of the transmitted electromagnetic wave, the long axis of the elliptical shape illustrated in FIG. 24 may be $\sqrt{2}$ times of the short axis.

Figure 25:
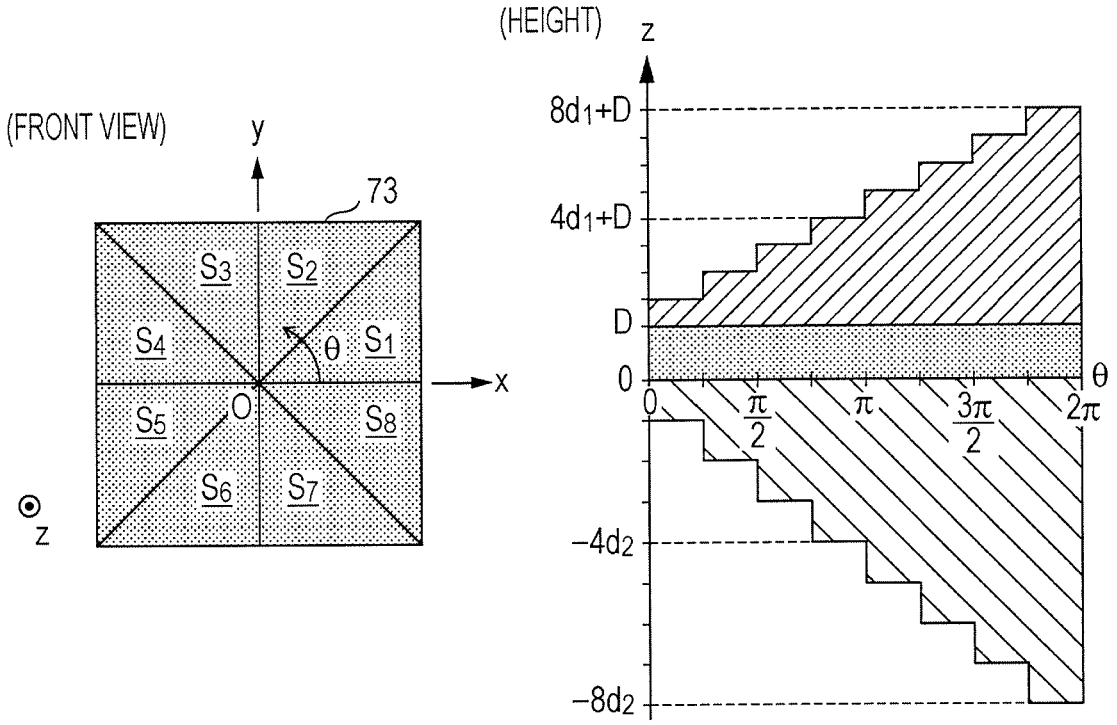
FIG. 25 illustrates an example that a thickness of the demultiplexer becomes thicker for an offset.

Although the thickness of the demultiplexers is $d_1+d_2$ or 2d (0 when continuously changing) in the thinnest region in the example illustrated in FIGS. 8 through 15, FIGS. 18 through 20, and the like, embodiments are not limited to this and a predetermined thickness may also be added. For example, as illustrated in FIG. 25, the thickness may also become thicker by the offset D in such a manner that the thickness of each of the eight regions $S_1$ to $S_8$ is $(d_1+d_2)+D$, $2(d_1+d_2)+D$, . . . , $8(d_1+d_2)+D$. This is preferred from the perspective of, for example, increasing the degree of freedom in designing front and back surfaces of the demultiplexer so as to appropriately change the quantum number of the orbital angular momentum (OAM) of the electromagnetic wave.

Descriptions have been given above to embodiments related to a demultiplexer, an antenna device, and a communication system in which the number of parts may be reduced by appropriately setting the front and back surface heights of the demultiplexer and integrating a half mirror and an OAM filter. However, the disclosed embodiments are not limited to the examples above. It will be understood by those skilled in the art that various modifications, alterations, alternatives, substitutions, and the like are possible by referring to the specification, the claims, and the drawings. Although specific numerical values have been exemplified to facilitate understanding of the embodiments, those numerical values are merely examples and any appropriate value may also be used unless otherwise specified. In addition, descriptions have been given using specific mathematical formulae to facilitate understanding of the embodiments, those formulae are merely examples, and other formulae producing similar results may also be used unless otherwise specified. The classification of headings in the above descriptions does not have to be made for the embodiments, and the matters described in two or more headings may also be used in combination as desired and a matter described in a certain heading may also be applied to a matter described in another heading (as long as there is no conflict).

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A device comprising a dielectric, wherein a front and a back of the dielectric for reflecting and transmitting an electromagnetic wave are defined by a first surface and a second surface, the dielectric forming a half mirror, the first surface has a height that changes in spiral when the first surface leaves from the second surface, and the second surface has a height that changes in spiral when the second surface leaves from the first surface.

2. The device according to claim 1, wherein the first surface has a height that changes in spiral as leaving from the second surface to cause orbital angular momentum of the electromagnetic wave to change by a predetermined value before and after reflection on the first surface.

3. The device according to claim 1, wherein the second surface has a height that changes in spiral as leaving from the first surface to cause orbital angular momentum of the electromagnetic wave to change by a predetermined value before and after transmission between the first and second surfaces.

4. The device according to claim 1, wherein the first surface has a height that changes by a first level difference in spiral as leaving from the second surface, and the second surface has a height that changes by a second level difference in spiral as leaving from the first surface.

5. The device according to claim 1, wherein the first surface has a continuously changing height at a first gradient in a spiral slide shape as leaving from the second surface, and the second surface has a continuously changing height at a second gradient in a spiral slide shape as leaving from the first surface.

6. An antenna device comprising:

a device that includes a dielectric for reflecting and transmitting an electromagnetic wave; and an antenna that sends an associated wave received from the device, wherein a front and a back of the dielectric of the device are defined by a first surface and a second surface and the dielectric forms a half mirror, the first surface has a height that changes in spiral when the first surface leaves from the second surface, the second surface has a height that changes in spiral when the second surface leaves from the first surface, and an electromagnetic wave reflected by the first surface, which is an electromagnetic wave having first orbital angular momentum, and an electromagnetic wave transmitted from the second surface to the first surface, which is an electromagnetic wave having second orbital angular momentum, are multiplexed to generate the associated wave.

7. The antenna device according to claim 6, wherein the antenna is a parabolic antenna.

8. An antenna device comprising:

a first device that includes a first dielectric for reflecting and transmitting an electromagnetic wave;

a second device that includes a second dielectric for reflecting and transmitting an electromagnetic wave; and an antenna that sends a second associated wave received from the second device, wherein a front and a back of the first dielectric of the first device are defined by a first surface and a second surface and the first dielectric forms a half mirror, the first surface has a height that changes in spiral when the first surface leaves from the second surface, the second surface has a height that changes in spiral when the second surface leaves from the first surface, an electromagnetic wave reflected by the first surface, which is an electromagnetic wave having first orbital angular momentum, and an electromagnetic wave transmitted from the second surface to the first surface, which is an electromagnetic wave having second orbital angular momentum, are multiplexed to generate a first associated wave, a front and a back of the second dielectric of the second device are defined by a third surface and a fourth surface, the third surface has a height that changes in spiral when the third surface leaves from the fourth surface, the fourth surface has a height that changes in spiral when the fourth surface leaves from the third surface, and an electromagnetic wave reflected by the third surface, which is an electromagnetic wave having third orbital angular momentum, and an electromagnetic wave outputted from the third surface when the first associated wave is transmitted from the fourth surface to the third surface are multiplexed to generate the second associated wave.

9. A communication system comprising:

a sending device that includes a multiplexing device including a first dielectric for reflecting and transmitting an electromagnetic wave and a sending and receiving antenna to send an associated wave; and a receiving device that includes a separating device including a receiving antenna to receive the associated wave and a second dielectric for reflecting and transmitting an electromagnetic wave, wherein a front and a back of the first dielectric of the multiplexing device are defined by a first surfaces and a second surface and the first dielectric forms a half mirror, the first surface has a height that changes in spiral when the first surface leaves from the second surface, the second surface has a height that changes in spiral when the second surface leaves from the first surface, an electromagnetic wave reflected by the first surface, which is an electromagnetic wave having first orbital angular momentum, and an electromagnetic wave transmitted from the second surface to the first surface, which is an electromagnetic wave having second orbital angular momentum, are multiplexed to generate the associated wave, a front and a back of the second dielectric of the separating device are defined by a third surface and a fourth surface, the third surface has a height that changes in spiral when the third surface leaves from the fourth surface, the fourth surface has a height that changes in spiral when the fourth surface leaves from the third surface, and the separating device obtains an electromagnetic wave incident on the first surface from an electromagnetic wave reflected by the third surface among the associated wave and obtains an electromagnetic wave incident on the second surface from an electromagnetic wave transmitted from the third surface to the fourth surface among the associated wave.

10. The device according to claim 1, wherein the height of the first surface corresponds to a thickness of the dielectric between the first surface and a reference surface, and the height of the second corresponds to a thickness of the dielectric between the second surface and the reference surface, the reference surface being assumed as a surface between the front and back of the dielectric.

* * * * *